US010909933B2

(12) United States Patent
Ahmed et al.

(10) Patent No.: US 10,909,933 B2
(45) Date of Patent: Feb. 2, 2021

(54) DIGITAL DRIVER FOR DISPLAYS

(71) Applicant: INTEL CORPORATION, Santa Clara, CA (US)

(72) Inventors: Khaled Ahmed, Anaheim, CA (US); Prakash K. Radhakrishnan, Portland, OR (US)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 15/387,963

(22) Filed: Dec. 22, 2016

(65) Prior Publication Data

US 2018/0182286 A1 Jun. 28, 2018

(51) Int. Cl.
*G09G 3/3283* (2016.01)
*G09G 3/3241* (2016.01)
*G09G 3/20* (2006.01)

(52) U.S. Cl.
CPC ..... *G09G 3/3283* (2013.01); *G09G 3/3241* (2013.01); *G09G 3/2014* (2013.01); *G09G 2300/0885* (2013.01); *G09G 2320/0233* (2013.01)

(58) Field of Classification Search
CPC ..... G09G 3/3233; G09G 3/3241; G09G 3/32
USPC ..... 345/690
See application file for complete search history.

(56) References Cited

U.S. PATENT DOCUMENTS 4,809,082 A 2/1989 Yamaguchi et al.
5,461,425 A 10/1995 Fowler et al.
5,751,263 A 5/1998 Huang et al.
6,392,616 B1 5/2002 Suzuki et al.
6,410,940 B1 6/2002 Jiang et al.
6,597,371 B2 7/2003 Mandl
8,258,450 B1 9/2012 Fries
9,369,651 B2 6/2016 Petilli
9,818,338 B2 * 11/2017 Ruan ..... G09G 3/32
2003/0090447 A1 * 5/2003 Kimura ..... G09G 3/3241 345/82
2004/0129933 A1 7/2004 Nathan et al.
2004/0201556 A1 10/2004 Oomori et al.
2004/0257251 A1 12/2004 Hsueh
2005/0012686 A1 * 1/2005 Osame ..... G09G 3/3233 345/39
2005/0052373 A1 3/2005 Devos et al.
2005/0067971 A1 * 3/2005 Kane ..... G09G 3/3233 315/169.3
2005/0200572 A1 9/2005 Weng
2005/0248583 A1 11/2005 Gotoda
2006/0066512 A1 3/2006 Afentakis
2006/0139343 A1 6/2006 Choi et al.
(Continued)

OTHER PUBLICATIONS

Greer, Trey, et al. "Hybrid Modulation for Near Zero Display Latency"; Society for Information Display, International Symposium, Digest of Technical Papers, vol. 47, Issue 1, May 2016, 3 pages.

(Continued)

*Primary Examiner* — Fred Tzeng
(74) *Attorney, Agent, or Firm* — Hanley, Flight & Zimmerman, LLC

(57) ABSTRACT

In one example, a system for driving current, including a circuit to receive an input voltage, and to produce a current to be provided to one or more light-emitting diodes. The current is to be linearly dependent on the input voltage.

25 Claims, 8 Drawing Sheets

(56) References Cited

U.S. PATENT DOCUMENTS

2007/0115226 A1 5/2007 Jung et al.
2007/0296354 A1 12/2007 Okabe
2008/0036708 A1 2/2008 Shirasaki et al.
2008/0084403 A1 4/2008 Kimura et al.
2008/0239124 A1 10/2008 Mori et al.
2008/0284691 A1 11/2008 Chung et al.
2008/0291125 A1* 11/2008 Yamashita ..... G09G 3/3233 345/55
2008/0303804 A1 12/2008 Schmidt et al.
2009/0295956 A1 12/2009 Chae et al.
2010/0181507 A1 7/2010 Maruyama
2011/0018787 A1* 1/2011 Nakamura ..... G09G 3/3233 345/76
2011/0068689 A1 3/2011 Scenini et al.
2011/0074758 A1 3/2011 Wacyk et al.
2011/0128278 A1* 6/2011 Schalberger ..... H05B 33/0896 345/212
2011/0210958 A1 9/2011 Yoo et al.
2012/0049762 A1 3/2012 Khalid
2012/0218314 A1 8/2012 Purdy et al.
2012/0320663 A1 12/2012 Kimura et al.
2013/0088468 A1 4/2013 Sakakura et al.
2013/0153893 A1 6/2013 Morosawa et al.
2013/0207957 A1 8/2013 Lin et al.
2014/0043068 A1 2/2014 Yamazaki
2014/0078191 A1 3/2014 Yang et al.
2015/0077615 A1 3/2015 Yamazaki et al.
2016/0044759 A1* 2/2016 Lai ..... H05B 33/0815 315/186
2016/0155828 A1 6/2016 Sugawara
2016/0189618 A1* 6/2016 Park ..... G09G 3/3233 345/690
2016/0260375 A1* 9/2016 Ruan ..... G09G 3/3233
2016/0277691 A1 9/2016 Jo
2016/0351096 A1 12/2016 Tani et al.
2016/0366733 A1* 12/2016 Wang ..... H05B 33/0815
2017/0039926 A1 2/2017 Greer, III
2017/0111056 A1 4/2017 Tkachev

OTHER PUBLICATIONS

Jang, Jae Hyuk, et al. "A Digital Driving Technique for an 8 AVGA AMOLED Display Using ΔΣ Modulation"; 2009 IEEE International Solid-State Circuits Conference—Digest of Technical Papers, Feb. 2009, 3 pages.

* cited by examiner

DIGITAL DRIVER FOR DISPLAYS

CROSS-REFERENCE TO RELATED APPLICATIONS

This application is related to U.S. patent application Ser. No. 15/387,967, filed on Dec. 22, 2016, titled "Low Power Dissipation Pixel for Displays". This application is also related to U.S. patent application Ser. No. 15/387,973, filed on Dec. 22, 2016, titled "Display Driver". This application is also related to U.S. patent application Ser. No. 15/387,979, filed on Dec. 22, 2016, titled "Current Programmed Pixel Architecture for Displays".

TECHNICAL FIELD

This disclosure relates to pixel driver circuitry for displays (for example, digitally driven pixel circuitry for light-emitting diode displays such as micro light-emitting diode displays).

BACKGROUND

Displays based on organic light-emitting diodes (OLEDs) and inorganic micro light-emitting diodes (also referred to as micro LEDs or μLEDs) have attracted increasing attention for applications in emerging portable electronics and wearable computers (for example, head mounted displays, head worn displays, wristwatches, wearable watch displays, Virtual Reality displays, Augmented Reality displays, OLED displays, micro LED displays, etc.).

BRIEF DESCRIPTION OF THE DRAWINGS

The following detailed description may be better understood by referencing the accompanying drawings, which contain specific examples of numerous features of the disclosed subject matter.

In some cases, the same numbers are used throughout the disclosure and the figures to reference like components and features. In some cases, numbers in the 100 series refer to features originally found in FIG. 1; numbers in the 200 series refer to features originally found in FIG. 2; and so on.

DESCRIPTION OF THE EMBODIMENTS

Some embodiments relate to displays, mobile displays and/or light-emitting diode (LED) displays.

As discussed above, displays based on organic light-emitting diodes (OLEDs) and inorganic micro light-emitting Diodes (also referred to as micro LEDs or μLEDs) have attracted increasing attention for applications in emerging portable electronics and wearable computers (for example, head mounted displays, head worn displays, wristwatches, wearable watch displays, Virtual Reality displays, Augmented Reality displays, OLED displays, micro LED displays, etc). In view of the typical small size of micro LEDs (for example, in the range of 10 μm or less), the current to drive a single micro LED for maximum luminance (for example in a range of 30-300 nits) can be in the 1-100 nA range. Several challenges can arise if analog pixel driver circuits are used for micro LEDs for such low currents.

It can be difficult for a current-source drive circuit to respond quickly enough to keep up with the display refresh rate when generating the small pixel currents that can be needed for micro LEDs. Additionally, the width to length (W/L) ratio of the drive transistor (or transistors) may need to shrink by a factor of about 10-100 to produce nanoamp-level (nA-level) currents. This is particularly difficult to realize given the dimensions of the pixels and the capabilities of the lithography used in display manufacturing.

In some embodiments, digital driving may be used to control gray levels using pulse width modulation (PWM) or pulse density modulation (PDM). Digital driving is compatible with digital video signals, which can help to simplify the system while additionally enhancing display resolution and gray levels. Additionally, in digital driving implementations according to some embodiments, a luminance uniformity of the pixels is not affected by threshold voltage shifts, since all transistors can work as switches, and all of the pixels can be driven by a uniform power supply current that drives light-emitting diodes (LEDs) in a manner that the brightness of the pixel can be controlled with a different programming signal.

Some embodiments relate to one or more digitally driven pixel circuits for displays.

Figure 1:
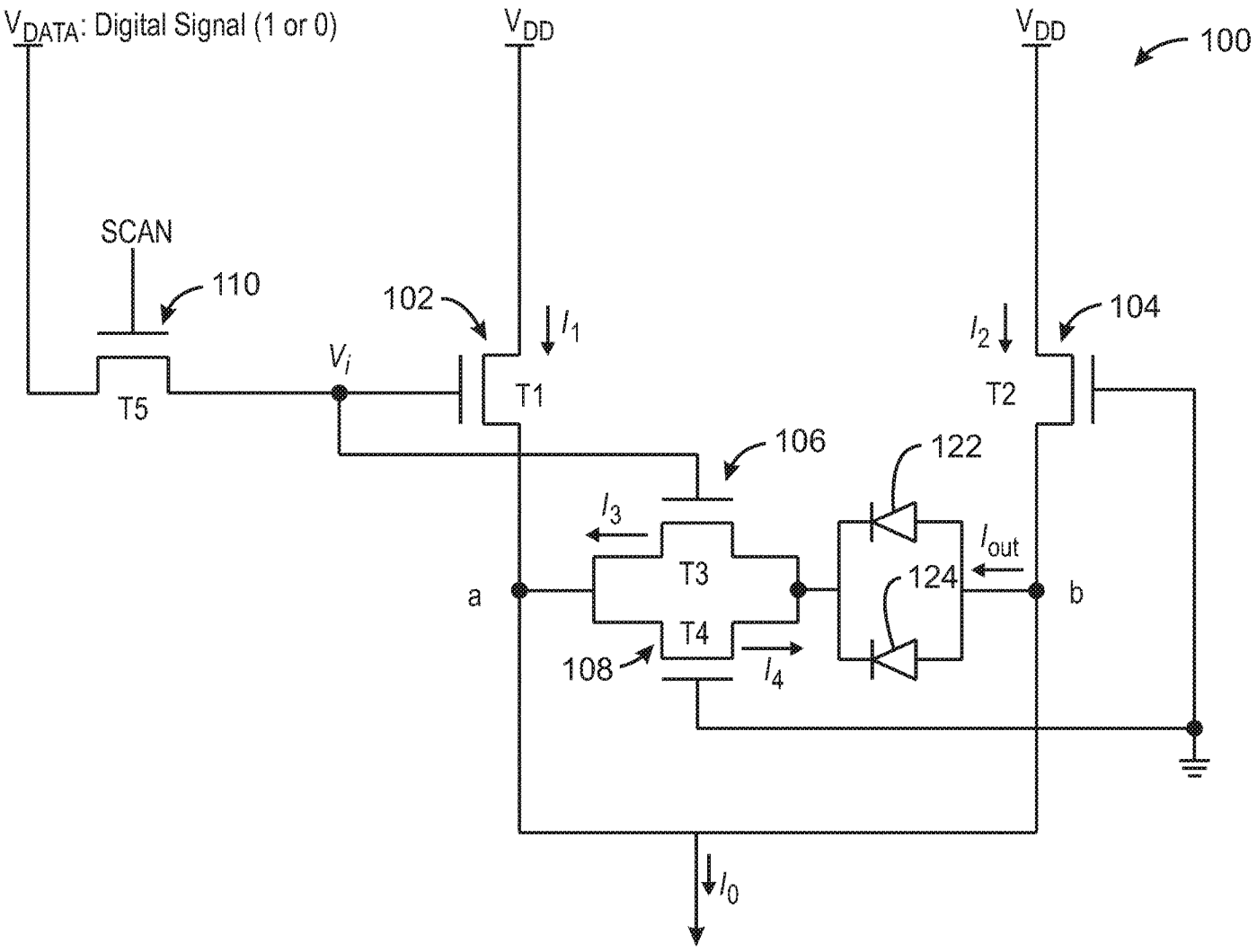
FIG. 1 illustrates an LED drive pixel circuit.

FIG. 1 is a circuit diagram of an LED digital drive pixel circuit 100. In some embodiments, circuit 100 is a current driver circuit. In some embodiments circuit 100 is a micro LED digital drive pixel circuit. Circuit 100 includes a transistor T1 102 (for example, an n channel Metal Oxide Semiconductor transistor, or nMOS transistor), a transistor T2 104 (for example, an nMOS transistor), a transistor T3 106 (for example, an nMOS transistor), a transistor T4 108 (for example, an nMOS transistor), and a transistor T5 110 (for example, an nMOS transistor). Circuit 100 additionally includes an LED 122 (for example, a micro LED) and an LED 124 (for example, a micro LED). In some embodiments, LED 122 and LED 124 are micro LEDs (μLEDs). As illustrated in FIG. 1, in some embodiments transistors 102, 104, 106, 108 and 110 are nMOS transistors. In some embodiments, transistor 102 (T1) and 104 (T2) together comprise a transconductor, a transconductance amplifier, and/or a differential transconductance amplifier. In some embodiments, transistor 106 (T3) and transistor 108 (T4) together comprise a linearizer, a linearizing circuit, a linearizing architecture and/or a linearizing feature. That is, transistors 106 and 108 are included in a linearizing architecture (or linearizing circuit) that is used to produce a dependence of the current on the input voltage $V_{DATA}$.

In some embodiments, $V_{DATA}$ is an input digital signal (for example, with a "0" or "1" digital signal value). When the SCAN signal goes high, transistor 110 (T5) will transmit the input data signal $V_{DATA}$ to transistor 102 (T1) via point $V_i$, which represents a point holding an input voltage $V_i$. When input data $V_{DATA}$ is passed to transistor 102 (T1) in this manner, two currents $I_1$ and $I_2$ will flow through transistors 102 (T1) and 104 (T2), respectively. The current $I_{out}$ that flows into the two LEDs 122 and 124 will then be proportional to the input voltage at point $V_i$ and/or will be proportional to the input voltage $V_{DATA}$.

In some embodiments, circuit 100 is a true current driver circuit. The bias current $I_0$ is set by a control circuit that is external to circuit 100. In some embodiments, current $I_0$ is provided by a constant current source circuit that is external to circuit 100. This external circuit may be included in a driver chip that is, for example, external to the display panel. In some embodiments, it may be implanted using complementary metal oxide semiconductor (CMOS) devices. In some embodiments, the external circuit providing current $I_0$ is outside of the TFT (thin-film-transistor) display backplane based on LED characteristics (for example, based on micro LED characteristics). The digital signal $V_{DATA}$, (for example using Pulse Width Modulation or Pulse Density Modulation), will control the average current $I_{out}$ flowing through the LEDs 122 and 124 (for example, micro LEDs), which controls the average brightness of the LEDs 122 and 124.

In some embodiments, transistors 102, 104, 106 and 108 are included in a transconductor, and/or a transconductance amplifier (for example, a differential transconductance amplifier). In some embodiments, the transconductor and/or transconductance amplifier including transistors 102, 104, 106 and 108 takes the input voltage (for example, $V_{DATA}$ and/or $V_i$) and creates a current proportional to that voltage (for example, where the current $I_{out}$ is proportional to the input voltage $V_{DATA}$ and/or input voltage $V_i$).

In some embodiments, transistors 102 and 104 are included in a transconductor, and/or a transconductance amplifier (for example, a differential transconductance amplifier), and/or transistors 106 and 108 are included in a linearizing architecture (and/or linearizing function, and/or linearizing circuit) used to produce a dependence of the current $I_{out}$ on the input voltage (for example, on $V_{DATA}$ and/or $V_i$). In some embodiments, transistors 102, 104, 106 and 108 are included in a linearized transconductance amplifier.

In some embodiments, a width to length ratio (W/L) of transistors 102 and 104 (for example, the same W/L ratio n for both transistors 102 and 104) and a width to length ratio (W/L) of transistors 106 and 108 (for example, the same W/L ratio m for both transistors 106 and 108) may be adjusted in order to obtain a desired target LED driving current $I_{out}$.

In some embodiments, driver circuit 100 handles multiple LEDs 122 and 124, and drives current to both of those LEDs. In some embodiments, redundant LEDs (such as, for example, micro LEDs) may be implemented. For example, redundant LEDs may be used where those redundant LEDs (such as LEDs 122 and 124) together provide brightness for a single pixel (and/or single color for each pixel) in a display array of pixels (for example, a mobile display array of pixels or an LED display array of pixels). In this manner, redundant LEDs may be used to provide a fault tolerance relating to the LEDs and the current $I_{out}$ that is driving the LEDs based on the input voltage $V_{DATA}$ and/or $V_i$. In this manner, if one LED is not working for some reason, the other LED can still provide the same amount of luminance that the two LEDs would have provided in parallel. While two redundant LEDs 122 and 124 have been illustrated and described herein, according to some embodiments, one single LED could be used and current driven to that one single LED, and according to some embodiments, more than two LEDs could be used and current driven to those LEDs (for example, using more than two redundant LEDs). It is noted that embodiments are not limited to two redundant LEDs as illustrated and described herein.

Figure 2:
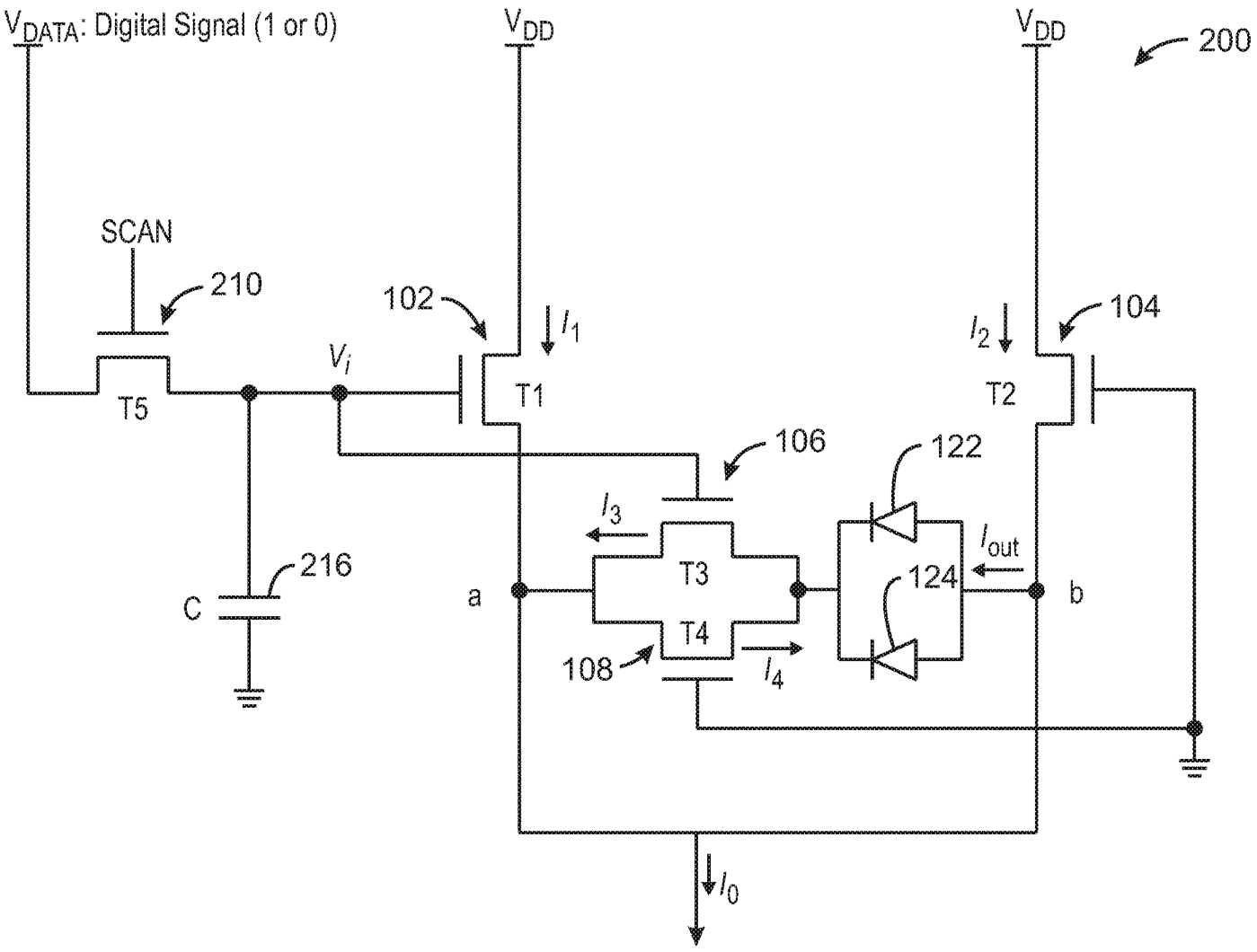
FIG. 2 illustrates an LED drive pixel circuit.
Figure 3:
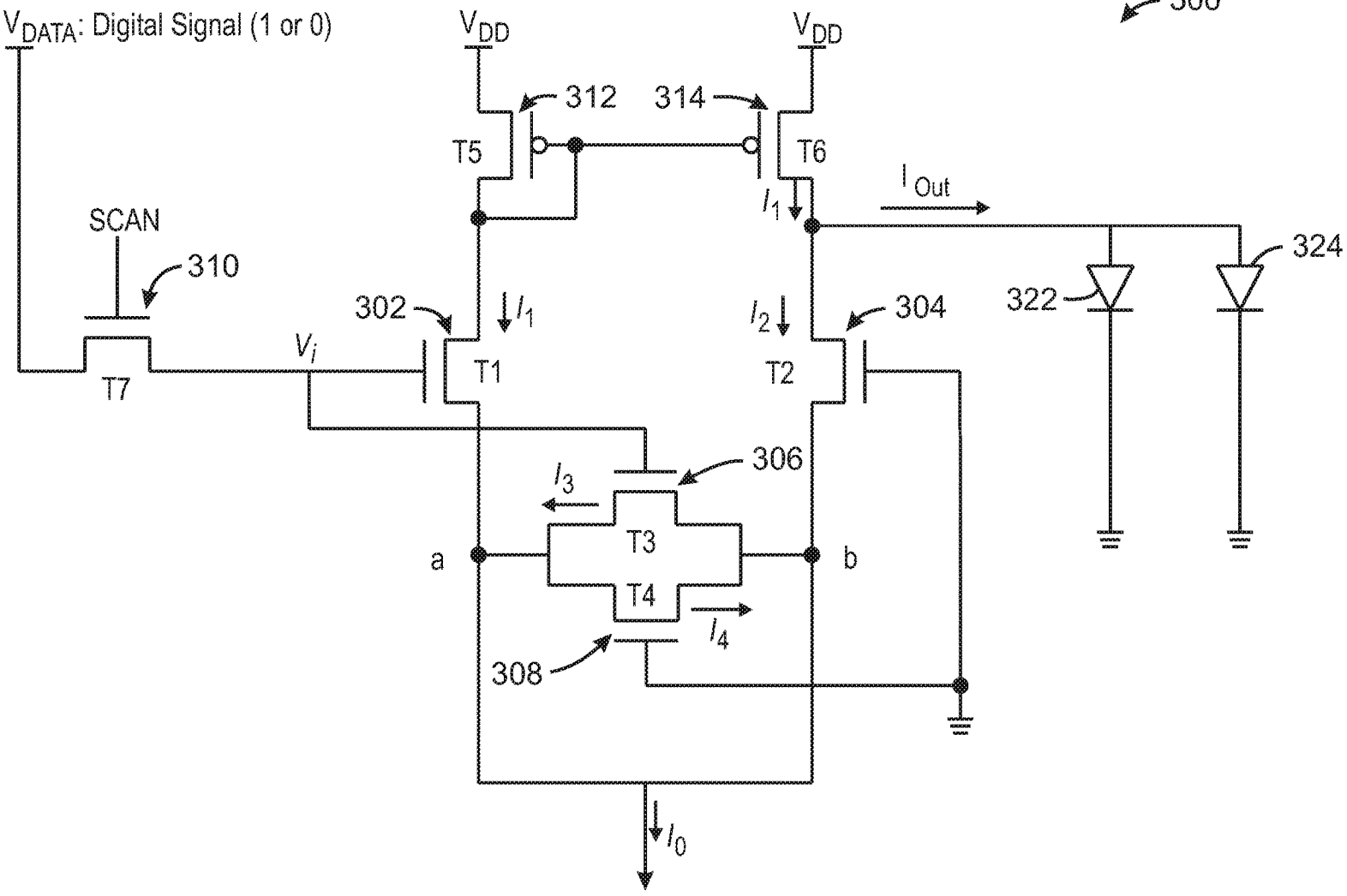
FIG. 3 illustrates an LED drive pixel circuit.

FIG. 3 is a circuit diagram of an LED digital drive pixel circuit 300. In some embodiments, circuit 300 is a current driver circuit. In some embodiments circuit 300 is a micro LED digital drive pixel circuit. In some embodiments, circuit 300 includes elements similar to those of circuit 200 illustrated in FIG. 2 and described in reference to FIG. 2. Circuit 300 includes a transistor T1 202 (for example, an nMOS transistor), a transistor T2 204 (for example, an nMOS transistor), a transistor T3 206 (for example, an nMOS transistor), a transistor T4 208 (for example, an nMOS transistor), and a transistor T5 210 (for example, an nMOS transistor). Circuit 300 additionally includes an LED 222 (for example, a micro LED) and an LED 224 (for example, a micro LED). In some embodiments, circuit 300 includes a capacitor C 316 between point $V_i$ and ground. In some embodiments, capacitor 316 is used to help hold the voltage level at point $V_i$. However, capacitor C 316 is optional in some embodiments. That is, in some embodiments capacitor 316 is not included (for example, as illustrated in circuit 100 of FIG. 1).

In some embodiments, the circuit 100 in FIG. 1 the circuit 200 in FIG. 2 may be implemented using IGZO (indium gallium zinc oxide) technology (using, for example, IGZO channel thin film transistors). In some embodiments, the circuit 100 in FIG. 1 and/or the circuit 200 in FIG. 2 may be implemented using LTPS (low—temperature polycrystalline silicon) technology (using, for example, LTPS channel thin film transistors).

In some embodiments, the circuit 100 in FIG. 1 and/or the circuit 200 in FIG. 2 may be implemented using nMOS technology.

In some embodiments (for example, some embodiments illustrated in and described in reference to FIG. 1 and/or FIG. 2), current $I_{out}$ may be calculated based on the following equation:

$$I_{out} = \frac{2m}{1 + \frac{4m}{n}} \sqrt{\frac{\mu C_{ox}}{n}} \sqrt{I_0}\, V_i \qquad \text{(EQUATION 1)}$$

Where n is the width to length ratio (W/L) of transistors 102 and 104 (T1 and T2), m is the width to length ratio (W/L) of transistors 106 and 108 (T3 and T4), μ is the mobility of electrons in the transistor channel, $C_{ox}$ is the gate oxide capacitance (or capacitance of the oxide layer) of transistors in the circuit 100 and/or 200, $I_0$ is the bias current $I_0$ illustrated in FIG. 1 or FIG. 2, for example, and $V_i$ is the input voltage at point $V_i$ in FIG. 1 or FIG. 2, for example.

In some embodiments, $t_{ox}$ is 30 nm, μ is 10 cm2/V-s, m is 2, n is 0.5, $I_0$ is 7.5 μA, Vi is 0.5V, and $I_{out}/2$ is 244 nA, while the current density is 1.0 A/cm$^2$, where $t_{ox}$ is the oxide thickness (and the oxide capacitance $C_{ox}$ is a dielectric constant divided by the oxide thickness $t_{ox}$), and $I_{out}/2$ represents a current flowing through each of the two LEDs. It is noted that the power efficiency of LEDs depends on the injected current density flowing through them. In some embodiments, a typical value of the current density at which the power efficiency of the LEDs peaks is 1 to 10 A/cm2.

In some embodiments, digital pixel driving circuit 100 and/or digital pixel driving circuit 200 are implemented using nMOS technology (for example, using nMOS devices, nMOS transistors, etc.). In some embodiments, digital pixel driving circuit 100 and/or digital pixel driving circuit 200 are implemented using low-temperature polycrystalline silicon (LTPS) channel thin film transistors (TFTs). In some embodiments, digital pixel driving circuit 100 and/or digital pixel driving circuit 200 are implemented using indium gallium zinc oxide (IGZO) channel thin film transistors (TFTs).

In some embodiments, transistors 102 and 104 of FIG. 1 and/or of FIG. 2 function as a differential transconductance amplifier. In some embodiments, transistors 106 and 108 of FIG. 1 and/or of FIG. 2 function as a linearizing circuit (and/or linearizing architecture) that is used to produce dependence of the current on the $V_i$ voltage (and/or the $V_{DATA}$ input voltage).

In the circuit 100 of FIG. 1 and/or in the circuit 200 of FIG. 2, the input data signal $V_{DATA}$ is received, and when the SCAN signal goes high, the $V_{DATA}$ signal is passed to transistor 102 via transistor 110 and voltage point Vi, and two currents $I_1$ and $I_2$ will flow through transistors 102 and 104, respectively. The current $I_{out}$ flowing through the LEDs 122 and 124 is proportional to the input voltage $V_i$. In this manner, the input voltage $V_i$ is propagated and spread to a current $I_{out}$ that flows to the LEDs 122 and 124. If one of the LEDs 122 and 124 is not working for some reason, the entire current $I_{out}$ can flow through the other LED 122 or 124 that is still working (for example, if one LED is not working due to a manufacturing defect in one of the LEDs or other loss of an LED). If both of the LEDs 122 and 124 are working, half of the current $I_{out}$ will flow through the LED 122 and the other half of the current $I_{out}$ will flow through the LED 124. In each of these situations, the luminance of the two LEDs is the same. That is, if current $I_{out}$ is flowing through only one of the LEDs 122 and 124 because the other LED is not working for some reason, the luminance of the working LED will be the same as the total luminance of both LEDs in a situation where both LEDs are working, and half of the driving current (Iout/2) flows through one of the LEDs and half of the driving current (Iout/2) flows through the other LED. Similarly, in embodiments where three LEDs are in parallel and one LED is not working, half the current $I_{out}$ will flow through each of the working LEDs, and in an embodiment where more LEDs are in parallel and one or more LED is not working, a proportional part of current $I_{out}$ will flow through each of the working LEDs. Therefore, the visual appearance in each of these situations to a viewer of the display in which circuit 100 and/or circuit 200 is included will be the same whether both LEDs 122 and 124 are working or only one of the LEDs 122 and 124 is working. A target brightness is the same in each situation. The current $I_{out}$ passes through the LEDs in such a way that the same luminance is provided when an LED goes out for any reason (and/or is non-functional upon manufacture thereof).

FIG. 3 is a circuit diagram of an LED digital drive pixel circuit 300. In some embodiments, circuit 300 is a current driver circuit. In some embodiments circuit 300 is a micro LED digital drive pixel circuit. Circuit 300 includes a transistor T1 302 (for example, an nMOS transistor), a transistor T2 304 (for example, an nMOS transistor), a transistor T3 306 (for example, an nMOS transistor), a transistor T4 308 (for example, an nMOS transistor), a transistor T7 310 (for example, an nMOS transistor), a transistor T5 312 (for example, a pMOS transistor), and a transistor T6 314 (for example, a pMOS transistor). Circuit 300 additionally includes an LED 322 (for example, a micro LED) and an LED 324 (for example, a micro LED). As illustrated in FIG. 3, in some embodiments transistors 302, 304, 306, 308 and 310 are nMOS transistors and transistors 312 and 314 are pMOS transistors.

In some embodiments, transistor 312 and 314 together are included in a current mirror. In some embodiments, the current mirror provides the same current $I_1$ flowing out of both transistors 312 and 314. In some embodiments, the current mirror copies the current $I_1$ through the transistors 312 and 314, keeping the current $I_1$ constant.

In some embodiments, transistor 302 (T1) and 304 (T2) together comprise a differential transconductance amplifier. In some embodiments, transistor 306 (T3) and transistor 308 (T4) together comprise a linearizer or linearizing feature. That is, transistors 306 and 308 are included in a linearizing architecture (or linearizing circuit) that is used to produce a dependence of the current on the input voltage $V_{DATA}$ and/or $V_i$. In some embodiments, transistors 302, 304, 306 and 308 are included in a linearized transconductance amplifier. In some embodiments, transistors 312 and 314 are included in a current mirror. In some embodiments, $V_{DATA}$ is an input digital signal (for example, with a "0" or "1" digital signal value).

When the SCAN signal goes high, transistor 310 (T7) can transmit the input data signal $V_{DATA}$ to transistor 302 (T1) via point $V_i$. When input data $V_{DATA}$ is passed to transistor 302 (T1) in this manner, two currents $I_1$ and $I_2$ flow through transistors 302 (T1) and 304 (T2), respectively. The current $I_{out}$ that flows into the two LEDs 322 and 324 may then be proportional to the input voltage at point $V_i$.

In some embodiments, the digital signal $V_{DATA}$, for example using pulse width modulation (PWM) or pulse density modulation (PDM), can control the average current $I_{out}$ flowing through the LEDs 322 and 324 (for example, micro LEDs), which controls the average brightness of the LEDs 322 and 324.

In some embodiments, transistors 302, 304, 306 and 308 are included in a transconductance amplifier (for example, a differential transconductance amplifier). In some embodiments, the transconductance amplifier including transistors 302, 304, 306 and 308 takes the input voltage (for example, $V_{DATA}$ and/or $V_i$) and creates a current proportional to that voltage (for example, where the current $I_{out}$ is proportional to the input voltage $V_{DATA}$ and/or $V_i$).

In some embodiments, transistors 302 and 304 are included in a transconductance amplifier (for example, a differential transconductance amplifier), and/or transistors 306 and 308 are included in a linearizing architecture (and/or linearizing function, and/or linearizing circuit) used to produce a dependence of the current $I_{out}$ on the input voltage (for example, $V_{DATA}$ and/or $V_i$). In some embodiments, transistors 302, 304, 306 and 308 are included in a linearized transconductance amplifier.

In some embodiments, a width to length ratio (W/L) of transistors 302 and 304 (for example, the same W/L ratio n for both transistors 302 and 304) and a width to length ratio (W/L) of transistors 306 and 308 (for example, the same W/L ratio n for both transistors 306 and 308) may be adjusted in order to obtain a desired target current $I_{out}$. In some embodiments, a width to length ratio (W/L) of transistors 312 and 314 are equal to each other.

Figure 4:
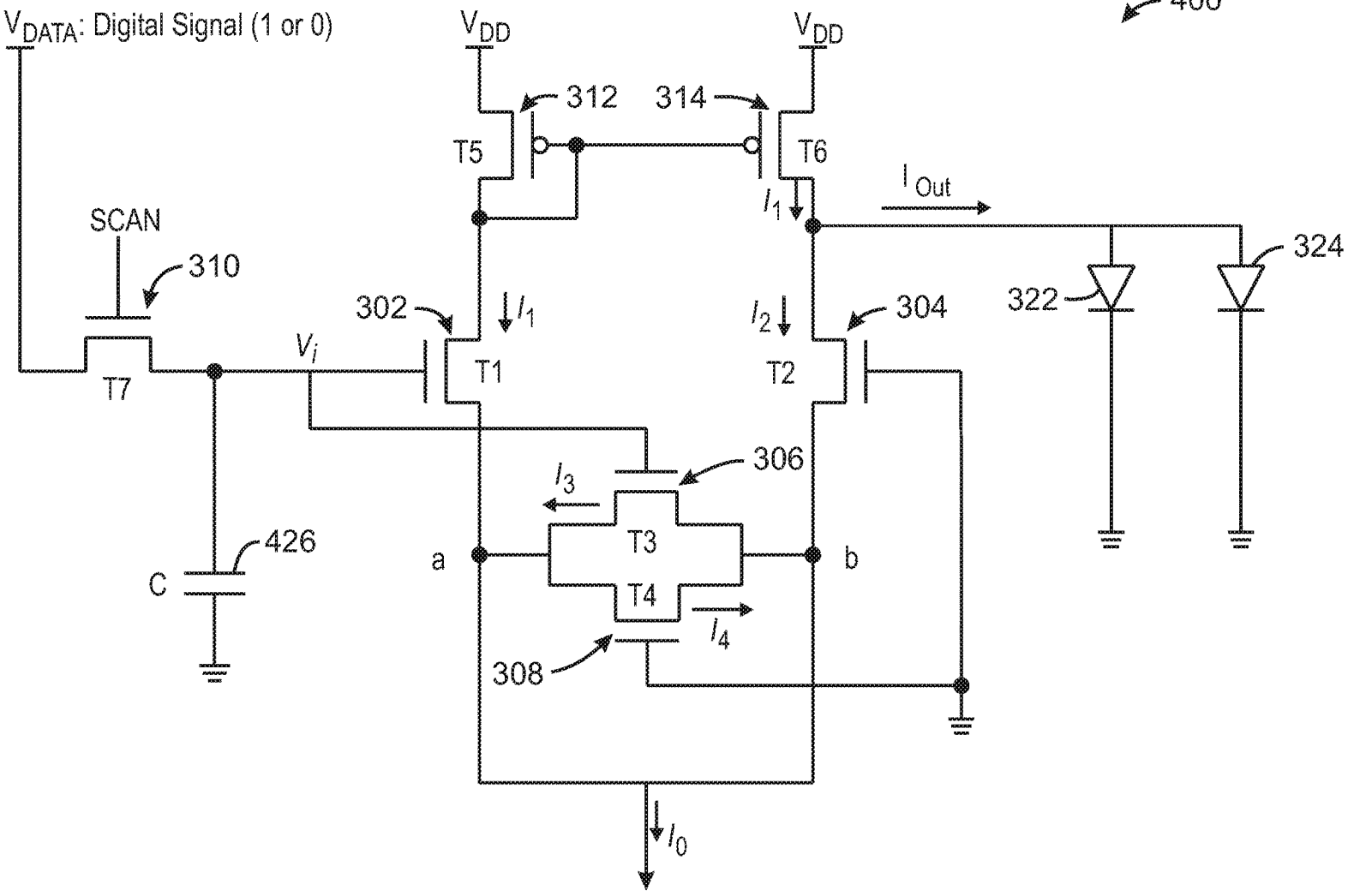
FIG. 4 illustrates an LED drive pixel circuit.

FIG. 4 is a circuit diagram of an LED digital drive pixel circuit 400. In some embodiments, circuit 400 is a current driver circuit. In some embodiments circuit 400 is a micro LED digital drive pixel circuit. In some embodiments, circuit 400 includes elements similar to those of circuit 300 illustrated in FIG. 3 and described in reference to FIG. 3. Circuit 400 includes a transistor T1 302 (for example, an nMOS transistor), a transistor T2 304 (for example, an nMOS transistor), a transistor T3 306 (for example, an nMOS transistor), a transistor T4 308 (for example, an nMOS transistor), a transistor T7 310 (for example, an nMOS transistor), a transistor T5 312 (for example, a pMOS transistor), and a transistor T6 314 (for example, a pMOS transistor). Circuit 400 additionally includes an LED 322 (for example, a micro LED) and an LED 324 (for example, a micro LED). In some embodiments, circuit 400 includes a capacitor C 426 between point $V_i$ and ground. In some embodiments, capacitor 526 is used to additionally hold the voltage level at point $V_i$. However, in some embodiments, capacitor 426 is not included (for example, as illustrated in circuit 300 of FIG. 3).

In some embodiments, a transconductance amplifier (for example, a linearizing transconductance amplifier) and a current mirror together provide a current driver circuit for LEDs (for example, for micro LEDs) that consumes ultralow power and operates the micro LEDs at optimal efficiency operating conditions.

In some embodiments, a circuit may be used to control current through LEDs (for example, micro LEDs) using:

an input data voltage with an ultralow voltage level (for example, less than 0.5V), resulting in low power consumption;

a small size (and/or width to length ratio or W/L ratio) for many or all of the transistors in the circuit, resulting in low power consumption; and/or a large bias current (for example, approximately 10 to 20 micro Amps), resulting in an ultrashort settling time.

In some embodiments, a combination of a transconductor (and/or a transconductance amplifier) and a current mirror in a display pixel driver, full control of the current may be obtained for luminance of one or more LEDs (for example, one or more micro LEDs) using digital driving techniques. In some embodiments, this can lead to lower power consumption. In this manner, in some embodiments, a better user experience may be obtained through lower power consumption, which could lead to thinner displays and/or longer battery life at a lower cost.

In the circuit 300 of FIG. 3 and/or in the circuit 400 of FIG. 4, the input data signal $V_{DATA}$ is received, and when the SCAN signal goes high, the $V_{DATA}$ signal can be passed to transistor 302 via transistor 310 through voltage point Vi, and two currents and $I_2$ can flow through transistors 302 and 304, respectively. The current $I_{out}$ flowing through the LEDs 322 and 324 is proportional to the input voltage $V_i$. In this manner, in some embodiments the input voltage $V_i$ is propagated and spread to a current $I_{out}$ that flows to the LEDs 322 and 324. If one of the LEDs 322 and 324 is not working for some reason, the entire current $I_{out}$ can flow through the other LED 322 or 324 that is still working (for example, due to a manufacturing defect in one of the LEDs or other loss of an LED). If both of the LEDs 322 and 324 are working, half of the current $I_{out}$ will flow through the LED 322 and the other half of the current $I_{out}$ will flow through the LED 324. In each of these situations, the luminance of the two LEDs is the same. That is, if current $I_{out}$ is flowing through only one of the LEDs 322 and 324 because the other LED is not working for some reason, the luminance of the working LED will be the same as the total luminance of both LEDs in a situation where both LEDs are working, and half of the driving current (Iout/2) can flow through one of the LEDs and half of the driving current (Iout/2) can flow through the other LED. Therefore, the visual appearance in each of these situations to a viewer of the display in which circuit 300 and/or circuit 400 is included will be the same whether both LEDs 322 and 324 are working or only one of the LEDs 322 and 324 is working. A target brightness is the same in each situation. The current $I_{out}$ can be passed through the LEDs in such a way that the same luminance is provided when an LED goes out for any reason (and/or is non-functional upon manufacture thereof).

In some embodiments, at least transistors 302, 304, 306, 308 and 310 of the circuit 300 in FIG. 3 (and/or the circuit 400 in FIG. 4) may be implemented using IGZO (indium gallium zinc oxide) technology (using, for example, IGZO channel thin film transistors). In some embodiments, at least transistors 302, 304, 306, 308 and 310 of the circuit 300 in FIG. 3 (and/or the circuit 400 in FIG. 4) may be implemented using LTPS (low—temperature polycrystalline silicon) technology (using, for example, LTPS channel thin film transistors). In some embodiments, transistors 312 and 314 of the circuit 300 in FIG. 3 (and/or the circuit 400 in FIG. 4) are implemented outside a chip in which other transistors of the circuit 300 in FIG. 3 (and/or the circuit 400 in FIG. 4) are implemented.

In some embodiments, the circuit 300 in FIG. 3 (and/or the circuit 400 in FIG. 4) may be implemented using Complementary Metal Oxide Semiconductor (CMOS) technology.

In some embodiments, in circuit 300 of FIG. 3 and/or in circuit 400 of FIG. 4, transistor T1 302, transistor T2 304, transistor T3 306 and/or transistor T4 308 are included in a transconductance amplifier. In some embodiments, in circuit 300 of FIG. 3 and/or in circuit 400 of FIG. 4, transistor T1 302, transistor T2 304, transistor T3 306 and/or transistor T4 308 are implemented using nMOS technology and/or are nMOS transistors. In some embodiments, in circuit 300 of FIG. 3 and/or in circuit 400 of FIG. 4, transistor T5 312 and/or transistor T6 314 are included in a current mirror. In some embodiments, in circuit 300 of FIG. 3 and/or in circuit 400 of FIG. 4, transistor T5 312 and/or transistor T6 314 are implemented using pMOS technology and/or are pMOS transistors. In some embodiments, in circuit 300 of FIG. 3 and/or in circuit 400 of FIG. 4, transistor T5 312 and/or transistor T6 314 are implemented on a separate integrated circuit chip than an integrated circuit chip on which transistor T1 302, transistor T2 304, transistor T3 306 and/or transistor T4 308 are implemented.

In some embodiments, in circuit 100 of FIG. 1, in circuit 200 of FIG. 2, in circuit 300 of FIG. 3, and/or in circuit 400 of FIG. 4, transistor T1 (102 and/or 302) and transistor T2 (104 and/or 304) are included in a differential transconductance amplifier, in a transconductance amplifier, and/or in a transconductor. In some embodiments, in circuit 100 of FIG. 1, in circuit 200 of FIG. 2, in circuit 300 of FIG. 3, and/or in circuit 400 of FIG. 4, transistor T3 (106 and/or 306) and transistor T4 (108 and/or 308) are included in a linearizing architecture. In some embodiments, a differential transconductance amplifier and/or a linearizing circuit are used to produce a linear dependence of a current driving one or more LEDs (for example, current $I_{out}$) on an input voltage (for example, $V_{DATA}$ and/or $V_i$).

In some embodiments, circuit 300 illustrated in FIG. 3 and/or circuit 400 illustrated in FIG. 4 operate similarly to circuit 100 of FIG. 1 and/or circuit 200 of FIG. 2. However, the current $I_{out}$ of FIG. 3 and/or FIG. 4 is provided at a different position in the circuit than that of FIG. 1 and/or FIG. 2.

In some embodiments, circuits 100 and 200 of FIG. 1 and FIG. 2 may be implemented using only nMOS devices. However, some embodiments of circuits 300 and 400 of FIG. 3 and FIG. 4 include pMOS devices in addition to nMOS devices.

It is noted that a difference in the value of the function of the output current $I_{out}$ as a function of the input voltage $V_i$ between circuits 100 and 200 versus that of circuits 300 and 400 can be minor in some embodiments. In some embodiments, the difference in the values of the output current $I_{out}$ between these circuits is merely a factor of two. In operation, the circuits can be similar in output value, but the circuits are slightly different and use different connections for the LEDs.

In some embodiments, each of these circuits uses a transconductance amplifier to take an input voltage and convert it to an output driving current for the LEDs that is proportional to the input voltage. The concept is similar, even though in some embodiments if the same variable values are used for each of the circuits, twice the amount of current is flowing through the LEDs relative to the input voltage. However, according to some embodiments, variables such as the width to length (W/L) ratios of the transistors (for example variables n and m) may be adjusted to provide similar currents through each of the LEDs.

In some embodiments, circuits 100, 200, 300, and/or 400 operate in a transition scheme. In some embodiments, transistors 102, 104, 102 and/or 104 operate in a saturation region of operation. In some embodiments, transistors 106, 108, 306 and/or 308 operate in a linear region of operation (for example, in order to provide linear dependence of the driving current $I_{out}$ on the input voltage $V_i$).

In some embodiments (for example, some embodiments illustrated in and described in reference to FIG. 1 and/or FIG. 2), current $I_{out}$ may be calculated based on the following equation:

$$I_{out} = \frac{2m}{1+\frac{4m}{n}}\sqrt{\frac{\mu C_{ox}}{n}}\sqrt{I_0}\,V_i \qquad \text{(EQUATION 1)}$$

Where n is the width to length ratio (W/L) of transistors 102 and 104 (T1 and T2), m is the width to length ratio (W/L) of transistors 106 and 108 (T3 and T4), μ is the mobility of electrons in the transistor channel, $C_{ox}$ is the gate oxide capacitance of transistors in the circuit 100 and/or 200, $I_0$ is the bias current $I_0$ illustrated in FIG. 1 and/or FIG. 2, for example, and where $V_i$ is the input voltage at point $V_i$ in FIG. 1 and/or FIG. 2, for example.

In some embodiments (for example, some embodiments illustrated in and described in reference to FIG. 3 and/or FIG. 4), current $I_{out}$ may be calculated based on the following equation:

$$I_{out} = \frac{4m}{1+\frac{4m}{n}}\sqrt{\frac{\mu C_{ox}}{n}}\sqrt{I_0}\,V_i \qquad \text{(EQUATION 2)}$$

Where n is the width to length ratio (W/L) of transistors 302 and 304 (T1 and T2), m is the width to length ratio (W/L) of transistors 306 and 308 (T3 and T4), μ is the mobility of electrons in the transistor channel, $C_{ox}$ is the gate oxide capacitance of transistors in the circuit 300 and/or 400, $I_0$ is the bias current $I_0$ illustrated in FIG. 3 and/or FIG. 4, for example, and $V_i$ is the input voltage at point $V_i$ in FIG. 3 and/or FIG. 4, for example.

As discussed herein, and as is evident from comparing Equation 1 and Equation 2, it is noted that a difference in the value of the function of the output current $I_{out}$ as a function of the input voltage $V_i$ between circuits 100 and 200 versus that of circuits 300 and 400 can be minor in some embodiments. In some embodiments, the difference in the values of the output current $I_{out}$ between these circuits is a factor of two (as illustrated, for example, by comparing Equation 1 and Equation 2).

Additional equations in reference to some embodiments (for example, some embodiments of FIG. 3 and/or FIG. 4) include the following, which may together be used to derive Equation 2 to determine $I_{out}$ as mentioned above:

$$V_a = V_i - V_{GS1} = V_i - V_{TH} - \sqrt{\frac{2I_1}{\mu C_{ox} n}} \qquad \text{(EQUATION 3)}$$

Where $V_a$ is the voltage at point a in FIG. 3 and/or FIG. 4, for example, $V_{GS1}$ is the gate to source voltage of transistor 302 (T1), for example, $V_{TH}$ is the threshold voltage of transistors in FIG. 3 and/or FIG. 4, for example, and $I_1$ is the current illustrated in FIG. 3 and/or FIG. 4, for example.

$$V_b = -V_{GS2} = -V_{TH} - \sqrt{\frac{2I_2}{\mu C_{ox} n}} \qquad \text{(EQUATION 4)}$$

Where $V_b$ is the voltage at point b in FIG. 3 and/or FIG. 4, for example, $V_{GS2}$ is the gate to source voltage of transistor 304 (T2), for example, $V_{TH}$ is the threshold voltage of transistors in FIG. 3 and/or FIG. 4, for example, and $I_2$ is the current $I_2$ illustrated in FIG. 3 and/or FIG. 4, for example.

$$I_1 - I_2 = 2(I_3 - I_4) \qquad \text{(EQUATION 5)}$$

Where $I_3$ is the current $I_3$ illustrated in FIG. 3 and/or FIG. 4, for example, and $I_4$ is the current $I_4$ illustrated in FIG. 3 and/or FIG. 4, for example.

$$I_3 = m\mu C_{ox}\left[(V_i - V_b - V_{TH})V_{ab} - \frac{1}{2}V_{ab}^2\right] \qquad \text{(EQUATION 6)}$$

Where $V_{ab}$ is the voltage differential between point a and point b of FIG. 3 and/or FIG. 4, for example.

$$I_4 = m\mu C_{ox}\left[(0 - V_a - V_{TH})V_{ba} - \frac{1}{2}V_{ba}^2\right] \qquad \text{(EQUATION 7)}$$

Where $V_{ba}$ is the voltage differential between point b and point a of FIG. 3 and/or FIG. 4, for example.

$$I_1 = \frac{1}{2}I_0 + I_3 - I_4 = \frac{1}{2}I_0 + x \qquad \text{(EQUATION 8)}$$

Where x is substituted for $I_3 - I_4$, for example.

$$I_2 = \frac{1}{2}I_0 - I_3 + I_4 = \frac{1}{2}I_0 - x \qquad \text{(EQUATION 9)}$$

Using Equations 3-7, the following can be derived:

$$I_3 - I_4 = \frac{nm}{n+4m}\sqrt{\frac{2\mu C_{ox}}{n}}\left(\sqrt{I_1} + \sqrt{I_2}\right)V_i \qquad \text{(EQUATION 10)}$$

Using Equations 8, 9, and 10, the following is derived:

$$x = \frac{nm}{n+4m}\sqrt{\frac{2\mu C_{ox}}{n}}\left(\sqrt{\frac{I_0}{2}+x}+\sqrt{\frac{I_0}{2}-x}\right)V_i \quad \text{(EQUATION 11)}$$

Solving the quadratic equation in x, the following simplified equation may be derived:

$$I_{out} = I_1 - I_2 = \frac{4m}{1+4m/n}\sqrt{\frac{\mu C_{ox}}{n}}\sqrt{I_0}\,V_i \quad \text{(EQUATION 12)}$$

It is noted that this equation for $I_{out}$ is valid, for example, when the following condition is satisfied:

$$V_i \ll \frac{n+4m}{nm}\sqrt{\frac{n}{4}}\sqrt{\frac{I_0}{\mu C_{ox}}} \quad \text{(EQUATION 13)}$$

In some embodiments, for $C_{ox}$=0.1 F/cm$^2$, μ=10 cm$^2$/V−s, $I_0$=10 μA, n=1, and m=4, then $V_i \leq 0.6$ V for the Equation 12 value of $I_{out}$ to be valid. In some embodiments, this is possible for thin film transistor (TFT) devices made with low-temperature polycrystalline silicon (LTPS) or indium gallium zinc oxide (IGZO) channels.

Figure 5:
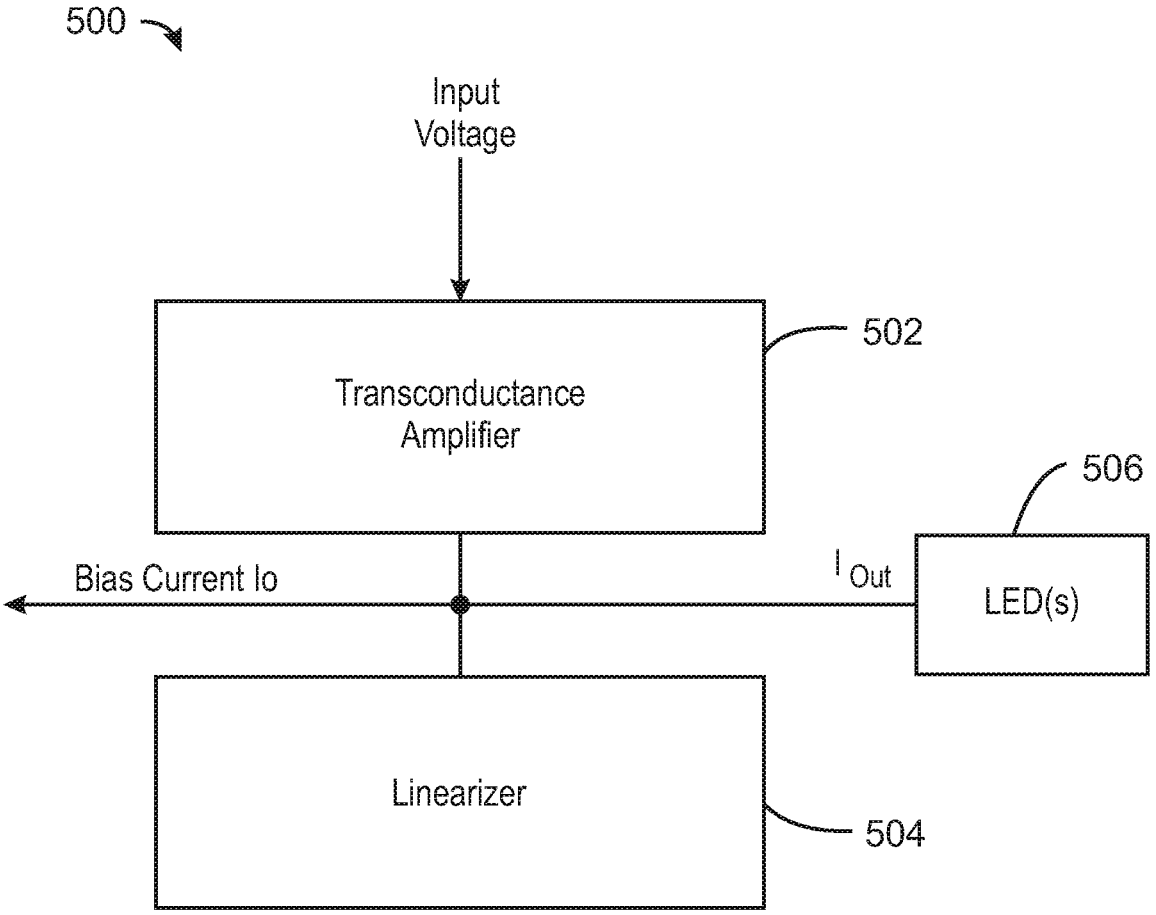
FIG. 5 illustrates a block diagram of an LED drive pixel circuit.

FIG. 5 is a block diagram of an LED digital drive pixel circuit 500. In some embodiments, circuit 500 is a current driver circuit. In some embodiments circuit 500 is a micro LED (μLED) digital drive pixel circuit. Circuit 500 includes a transconductor 502 (for example, in some embodiments, a transconductance amplifier 502), a linearizer 504, and one or more LEDs 506. In some embodiments, transconductor 502 is a differential transconductance amplifier. In some embodiments, transconductor 502 can include two transistors such as, for example, transistors 102 and 104 of FIG. 1 and/or FIG. 2, or transistors 302 and 304 of FIG. 3 and/or FIG. 4. In some embodiments, linearizer 504 includes a linearizing architecture (and/or linearizing circuit) used to produce a dependence of a driving current provided to the one or more LEDs 506 based on the input voltage. In some embodiments, transconductor 502 and linearizer 504 are combined into a linearized transconductance amplifier (for example, in some embodiments, including transistors 102, 104, 106 and 108 of FIG. 1 and/or FIG. 2, or in some embodiments, including transistors 302, 304, 306 and 308 of FIG. 3 and/or FIG. 4). In some embodiments, transconductor 502 provides a driving current $I_{out}$ to LED(s) 506. In some embodiments, linearizer 504 provides a driving current $I_{out}$ to LED(s) 506. In some embodiments, both transconductor 502 and linearizer 504 together provide a driving current $I_{out}$ to LED(s) 506. In some embodiments, transconductor 502 provides a bias current $I_o$. In some embodiments, linearizer 504 provides a bias current $I_o$. In some embodiments, both transconductor 502 and linearizer 504 together provide a bias current $I_o$. In some embodiments, LED(s) 506 can include two or more LEDs such as, for example, LEDs 122 and 124 of FIG. 1 and/or FIG. 2, or for example, LEDs 322 and 324 of FIG. 3 and/or FIG. 4.

In some embodiments, the current $I_{out}$ driving LED(s) 506 has a linear dependence on the input voltage.

Figure 6:
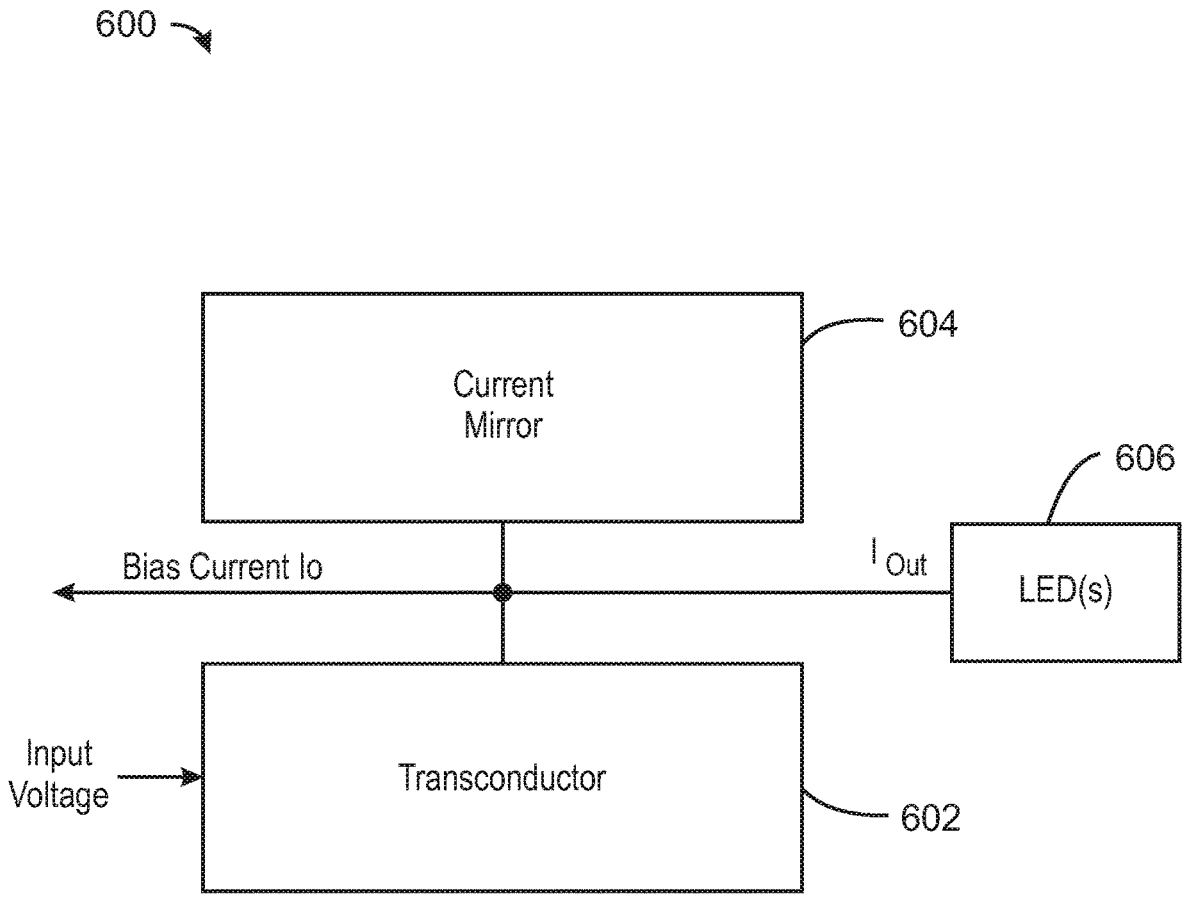
FIG. 6 illustrates a block diagram of an LED drive pixel circuit.

FIG. 6 is a block diagram of an LED digital drive pixel circuit 600. In some embodiments, circuit 600 is a current driver circuit. In some embodiments circuit 600 is a micro LED (μLED) digital drive pixel circuit. Circuit 600 includes a transconductor 602 (for example, in some embodiments a transconductance amplifier 602), a current mirror 604, and one or more LEDs 606. In some embodiments, transconductor 602 is a differential transconductance amplifier. In some embodiments, transconductor 602 can include two transistors such as, for example, transistors 102 and 104 of FIG. 1 and/or FIG. 2, or transistors 302 and 304 of FIG. 3 and/or FIG. 4. In some embodiments, transconductor 602 can include a linearizing architecture (and/or linearizing circuit) used to produce a dependence of a driving current provided to the one or more LEDs 606 based on the input voltage. In some embodiments, transconductor 602 is a linearized transconductance amplifier (for example, in some embodiments, including transistors 102, 104, 106 and 108 of FIG. 1 and/or FIG. 2, or in some embodiments, including transistors 302, 304, 306 and 308 of FIG. 3 and/or FIG. 4). In some embodiments, current mirror 604 can include two transistors such as, for example, transistors 312 and 314 of FIG. 3 and/or FIG. 4. In some embodiments, transconductor 602 provides a driving current $I_{out}$ to LED(s) 606. In some embodiments, current mirror 604 provides a driving current $I_{out}$ to LED(s) 606. In some embodiments, both transconductor 602 and current mirror 604 together provide a driving current $I_{out}$ to LED(s) 606. In some embodiments, transconductor 602 provides a bias current $I_o$. In some embodiments, current mirror 604 provides a bias current $I_o$. In some embodiments, both transconductor 602 and current mirror 604 together provide a bias current $I_o$. In some embodiments, LED(s) 606 can include two or more LEDs such as, for example, LEDs 122 and 124 of FIG. 1 and/or FIG. 2, or for example, LEDs 322 and 324 of FIG. 3 and/or FIG. 4.

In some embodiments, the current $I_{out}$ driving LED(s) 606 has a linear dependence on the input voltage.

In some embodiments, a driver circuit (for example, such as driver circuit 100, driver circuit 200, driver circuit 300, driver circuit 400, driver circuit 500, driver circuit 600, etc.) is provided for each pixel in a display. For example, a display with 400 lines and 400 columns could include 160,000 driver circuits times the number of colors. For example, in some embodiments there are three colors in a red green blue (or RGB) system, and there would be 480,000 driver circuits (and 960,000 LEDs since there are two LEDs per circuit) for the 400×400 display (160,000 times 3, since each color would have a separate driver circuit for each of the pixels in the array).

Figure 7:
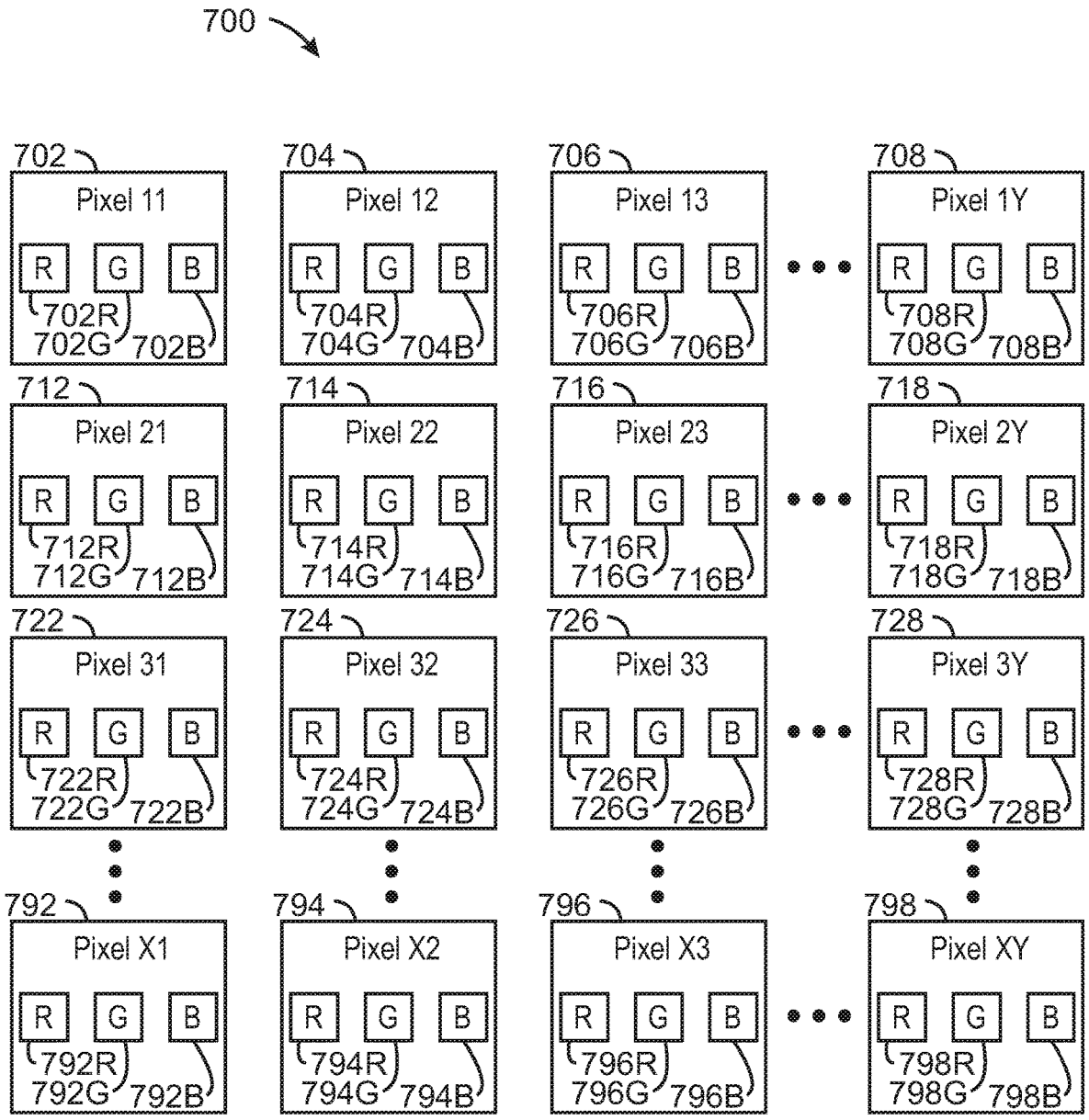
FIG. 7 illustrates a block diagram of a display pixel driving system.

FIG. 7 illustrates a display pixel driver system 700 (for example, a mobile display pixel driver system, an OLED pixel driver system, and/or a micro LED pixel driver system). Pixel driver system 700 displays pixels in X rows and Y columns. In some embodiments, pixel driver system 700 displays pixels in 400 rows and 400 columns. Each pixel in the system 700 includes a number of driver circuits. For example, as illustrated in FIG. 7, each pixel includes a driver circuit for each of a number of colors in the driver system (for example, as illustrated in FIG. 7, a separate pixel driver circuit for each of red (R), blue (B), and green (G) pixels. FIG. 7 illustrates Y pixels in each row. Row 1 includes pixel 11 (702) with a red pixel driver circuit 702R, a green pixel driver circuit 702G and a blue pixel driver circuit 702B, pixel 12 (704) with a red pixel driver circuit 704R, a green pixel driver circuit 704G and a blue pixel driver circuit 704B, pixel 13 (706) with a red pixel driver circuit 706R, a green pixel driver circuit 706G and a blue pixel driver circuit 706B, . . . , pixel 1Y (708) with a red pixel driver circuit 708R, a green pixel driver circuit 708G and a blue pixel driver circuit 708B. Row 2 includes pixel 21 (712) with a red pixel driver circuit 712R, a green pixel driver circuit 712G and a blue pixel driver circuit 712B, pixel 22 (714) with a red pixel driver circuit 714R, a green pixel driver circuit 714G and a blue pixel driver circuit 714B, pixel 23 (716) with a red pixel driver circuit 716R, a green pixel driver circuit 716G and a blue pixel driver circuit 716B, . . . , pixel 2Y (718) with a red pixel driver circuit 718R, a green pixel driver circuit 718G and a blue pixel driver circuit 718B. Row 3 includes pixel 31 (722) with a red pixel driver circuit 722R, a green pixel driver circuit 722G and a blue pixel driver circuit 722B, pixel 32 (724) with a red pixel driver circuit 724R, a green pixel driver circuit 724G and a blue pixel driver circuit 724B, pixel 33 (726) with a red pixel driver circuit 726R, a green pixel driver circuit 726G and a blue pixel driver circuit 726B, . . . , pixel 3Y (728) with a red pixel driver circuit 728R, a green pixel driver circuit 728G and a blue pixel driver circuit 728B. Row X includes pixel X1 (792) with a red pixel driver circuit 792R, a green pixel driver circuit 792G and a blue pixel driver circuit 792B, pixel X2 (794) with a red pixel driver circuit 794R, a green pixel driver circuit 794G and a blue pixel driver circuit 794B, pixel X3 (796) with a red pixel driver circuit 796R, a green pixel driver circuit 796G and a blue pixel driver circuit 796B, . . . , pixel XY (798) with a red pixel driver circuit 798R, a green pixel driver circuit 798G and a blue pixel driver circuit 798B.

In some embodiments, one or more of the pixel driver circuits in the system 700 (for example, circuits 702R, 702G, 702B, 704R, 704G, 704B, 706R, 706G, 706B, . . . , 708R, 708G, 708B, 712R, 712G, 712B, 714R, 714G, 714B, 716R, 716G, 716B, . . . , 718R, 718G, 718B, 722R, 722G, 722B, 724R, 724G, 724B, 726R, 726G, 726B, . . . , 728R, 728G, 728B, . . . , 792R, 792G, 792B, 794R, 794G, 794B, 796R, 796G, 796B, . . . , 798R, 798G, 798B) may be implemented using one or more of the circuits 100, 200, 300, 400, 500, or 600 described herein. In some embodiments, each of the pixel driver circuits in the system 700 (for example, circuits 702R, 702G, 702B, 704R, 704G, 704B, 706R, 706G, 706B, . . . , 708R, 708G, 708B, 712R, 712G, 712B, 714R, 714G, 714B, 716R, 716G, 716B, . . . , 718R, 718G, 718B, 722R, 722G, 722B, 724R, 724G, 724B, 726R, 726G, 726B, . . . , 728R, 728G, 728B, . . . , 792R, 792G, 792B, 794R, 794G, 794B, 796R, 796G, 796B, . . . , 798R, 798G, 798B) may be implemented using one or more of the circuits 100, 200, 300, 400, 500, or 600 described herein.

In some embodiments of FIG. 7, a driver circuit (for example, such as driver circuit 100, driver circuit 200, driver circuit 300, driver circuit 400, driver circuit 500, driver circuit 600, etc.) is provided for each pixel in a display. For example, a display with 400 lines and 400 columns would include 160,000 driver circuits times the number of colors. For example, in some embodiments there are three colors in a red green blue (or RGB) system, and 480,000 driver circuits (and in some embodiments, 960,000 LEDs, with two redundant LEDs per driver circuit) for the 400×400 display (160,000 times 3, since each color has a separate driver circuit for each of the pixels in the array).

In some embodiments, a self-compensated circuit is provided with regard to threshold variation (for example, due to process variations, transistor instability, etc). In some embodiments, a true digital current driving circuit may be implemented without long settling time issues. In some embodiments, micro LED current may be controlled in the nano ampere level without sacrificing display quality or sacrificing speed due to settling times. In some embodiments, a pixel driving circuit consumes ultralow power since the applied data voltage is low in amplitude (for example, below 0.5V).

In some embodiments, a linearized transconductance amplifier and a current mirror are combined to produce a true current driver circuit for micro LEDs that consumes ultralow power and operates micro LEDs at optimal efficiency operating conditions.

In some embodiments, a digital pixel driving circuit is implemented using Complementary Metal Oxide Semiconductor (CMOS) technology (for example, including pMOS and nMOS transistors). In some embodiments, a digital pixel driving circuit is implemented using n channel Metal Oxide Semiconductor (nMOS) technology (for example, using nMOS transistors). In some embodiments, a digital pixel driving circuit is implemented using low-temperature polycrystalline silicon (LTPS) channel thin film transistors (TFTs). In some embodiments, a digital pixel driving circuit is implemented using indium gallium zinc oxide (IGZO) channel thin film transistors (TFTs).

In some embodiments, one or more of a current mirror, a transconductance amplifier, a linearizer, a linearizing architecture, a linearizing circuit, or a linearized transconductance amplifier may be used to take an input voltage and create an LED driving current proportional to that voltage. In some embodiments, the width to length ratio of transistors in a differential transconductance amplifier (for example, in some embodiments, the W/L ratio n of transistors 102 and 104 of FIG. 1 or FIG. 2, and in some embodiments, the W/L ratio n of transistors 302 and 304 of FIG. 3 or FIG. 4) may be adjusted to obtain a target driving current (for example, driving current $I_{out}$ in one or more of the embodiments described herein). In some embodiments, the width to length ratio of transistors in a linearizer, linearizing architecture and/or linearizing circuit (for example, in some embodiments, the W/L ratio m of transistors 106 and 108 of FIG. 1 or FIG. 2, and in some embodiments, the W/L ratio m of transistors 306 and 308 of FIG. 3 or FIG. 4) may be adjusted to obtain a target driving current (for example, driving current $I_{out}$ in one or more of the embodiments described herein).

In some embodiments, multiple LEDs are arranged (for example, in parallel with each other) for each pixel in a display for fault tolerance purposes. Some embodiments relate to handling multiple LEDs (for example, multiple micro LEDs) using one driver circuit. For example, in some embodiments, multiple redundant LEDs are arranged (for example in parallel) for each pixel in a display. In some embodiments, a driver circuit provides linear dependence of the current that is driving the LEDs based on the input voltage.

In some embodiments, a driver circuit handles multiple LEDs, and provides a driving current to each of those LEDs. In some embodiments, redundant LEDs (such as, for example, micro LEDs) may be implemented (for example, in some embodiments, driver circuit 100, driver circuit 200, driver circuit 300, driver circuit 400, driver circuit 500, driver circuit 600, etc). For example, redundant LEDs may be used where those redundant LEDs together provide brightness for a single pixel (and/or single color for each pixel) in a display array of pixels (for example, a mobile display array of pixels). In this manner, redundant LEDs may be used to provide a fault tolerance relating to the LEDs and the current $I_{out}$ that is driving the LEDs based on the input voltage (for example, "input voltage", $V_{DATA}$ and/or $V_i$). In this manner, if one LED is not working for some reason, one or more other LEDs still provide the same amount of luminance that all of the LEDs would have together provided in parallel. While two redundant LEDs have been illustrated and described herein, according to some embodiments, one single LED can be used and current driven to that one single LED. Similarly, according to some embodiments, more than two LEDs can be used and current driven to those LEDs (for example, using more than two redundant LEDs). It is noted that embodiments are not limited to two redundant LEDs as illustrated and described herein.

Reference in the specification to "one embodiment" or "an embodiment" or "some embodiments" of the disclosed subject matter means that a particular feature, structure, or characteristic described in connection with the embodiment is included in at least one embodiment of the disclosed subject matter. Thus, the phrase "in one embodiment" or "in some embodiments" may appear in various places throughout the specification, but the phrase may not necessarily refer to the same embodiment or embodiments.

Figure 8:
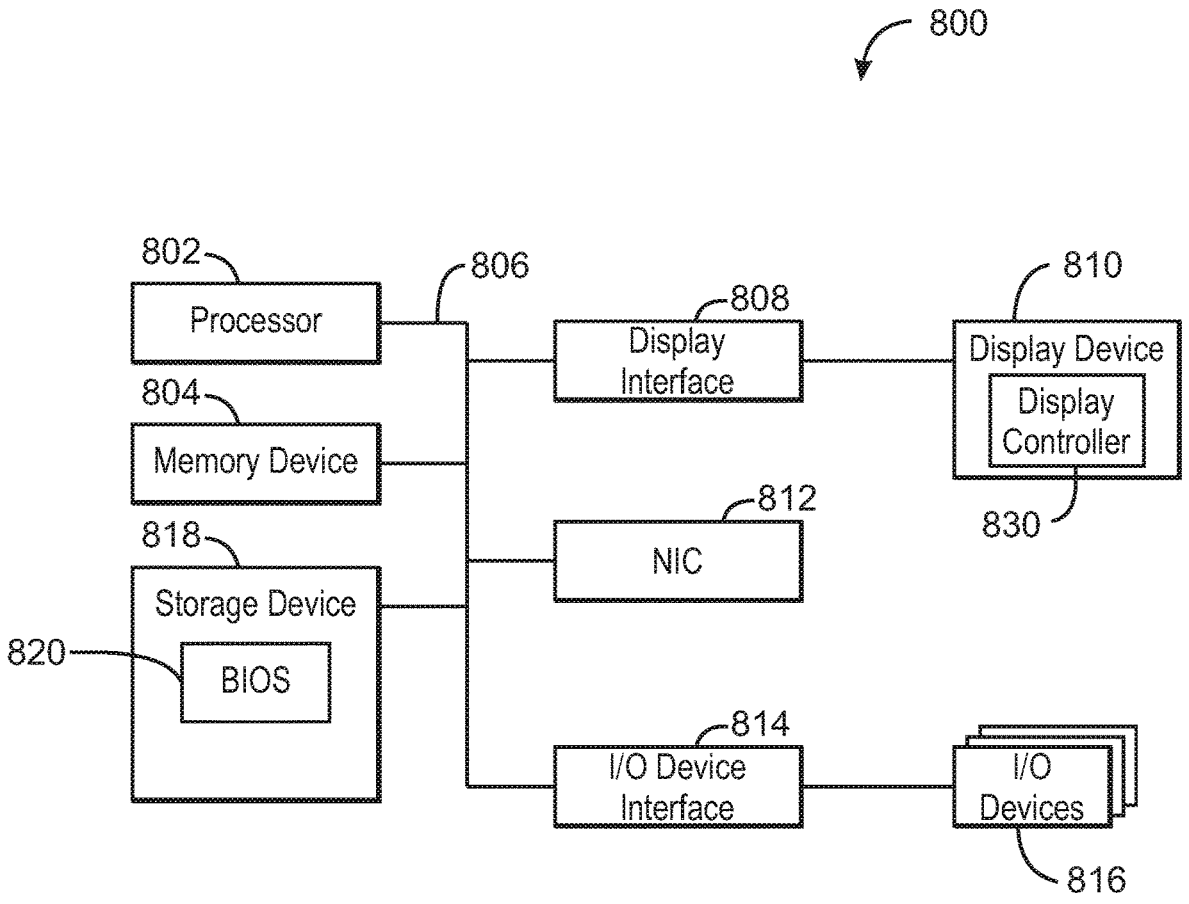
FIG. 8 illustrates a block diagram of a computing device.

FIG. 8 is a block diagram of an example of a computing device 800 that can drive pixels in a display. In some embodiments, any portion of the circuits and/or systems illustrated in any one or more of FIGS. 1-7, and any of the embodiments described herein can be included in and/or be implemented by computing device 800. The computing device 800 may be, for example, a mobile phone, mobile device, handset, laptop computer, desktop computer, or tablet computer, among others. The computing device 800 may include a processor 802 that is adapted to execute stored instructions, as well as a memory device 804 (and/or storage device 804) that stores instructions that are executable by the processor 802. The processor 802 can be a single core processor, a multi-core processor, a computing cluster, or any number of other configurations. For example, processor 802 can be an Intel® processor such as an Intel® Celeron, Pentium, Core, Core i3, Core i5, or Core i7 processor. In some embodiments, processor 802 can be an Intel® x86 based processor. In some embodiments, processor 802 can be an ARM based processor. The memory device 804 can be a memory device and/or a storage device, and can include volatile storage, non-volatile storage, random access memory, read only memory, flash memory, or any other suitable memory or storage systems. The instructions that are executed by the processor 802 may also be used to implement display driver control as described in this specification.

The processor 802 may also be linked through the system interconnect 806 (e.g., PCI®, PCI-Express®, NuBus, etc.) to a display interface 808 adapted to connect the computing device 800 to a display device 810. The display device 810 may include a display screen that is a built-in component of the computing device 800. The display device 810 may also include a computer monitor, television, or projector, among others, that is externally connected to the computing device 800. The display device 810 can include light emitting diodes (LEDs), organic light emitting diodes (OLEDs), and/or micro-LEDs, among others.

In some embodiments, the display interface 808 can include any suitable graphics processing unit, transmitter, port, physical interconnect, and the like. In some examples, the display interface 808 can implement any suitable protocol for transmitting data to the display device 810. For example, the display interface 808 can transmit data using a high-definition multimedia interface (HDMI) protocol, a DisplayPort protocol, or some other protocol or communication link, and the like In some embodiments, display device 810 includes a display controller 830. In some embodiments, the display controller 830 can provide control signals within and/or to the display device 810. In some embodiments, display controller 830 can be included in the display interface 808 (and/or instead of the display interface 808). In some embodiments, display controller 830 can be coupled between the display interface 808 and the display device 810. In some embodiments, the display controller 830 can be coupled between the display interface 808 and the interconnect 806. In some embodiments, the display controller 830 can be included in the processor 802. In some embodiments, display controller 830 can implement driving of display pixels as described herein (for example, as illustrated in and described in reference to any of the circuits and/or systems of FIGS. 1-7). In some embodiments, display controller 830 and/or display device 810 can include a display driver pixel system such as system 700 of FIG. 7. In some embodiments, a driver circuit (for example, such as driver circuit 100 of FIG. 1, driver circuit 200 of FIG. 2, driver circuit 300 of FIG. 3, driver circuit 400 of FIG. 4, driver circuit 500 of FIG. 5, and/or driver circuit 600 of FIG. 6) is provided for one or more pixel (or each pixel) in a display, and is included in display device 810 and/or display controller 830.

In addition, a network interface controller (also referred to herein as a NIC) 812 may be adapted to connect the computing device 800 through the system interconnect 806 to a network (not depicted). The network (not depicted) may be a cellular network, a radio network, a wide area network (WAN), a local area network (LAN), or the Internet, among others.

The processor 802 may be connected through system interconnect 806 to an input/output (I/O) device interface 814 adapted to connect the computing host device 800 to one or more I/O devices 816. The I/O devices 816 may include, for example, a keyboard and/or a pointing device, where the pointing device may include a touchpad or a touchscreen, among others. The I/O devices 816 may be built-in components of the computing device 800, or may be devices that are externally connected to the computing device 800.

In some embodiments, the processor 802 may also be linked through the system interconnect 806 to a storage device 818 that can include a hard drive, a solid state drive (SSD), a magnetic drive, an optical drive, a USB flash drive, an array of drives, or any other type of storage, including combinations thereof. In some embodiments, the storage device 818 can include any suitable applications. In some embodiments, the storage device 818 can include a basic input/output system (BIOS) 820.

It is to be understood that the block diagram of FIG. 8 is not intended to indicate that the computing device 800 is to include all of the components shown in FIG. 8. Rather, the computing device 800 can include fewer or additional components not illustrated in FIG. 8 (e.g., additional memory components, embedded controllers, additional modules, additional network interfaces, etc.). Furthermore, any of the functionalities of the BIOS 820 may be partially, or entirely, implemented in hardware and/or in the processor 802. For example, the functionality may be implemented with an application specific integrated circuit, logic implemented in an embedded controller, or in logic implemented in the processor 802, among others. In some embodiments, the functionalities of the BIOS 820 can be implemented with logic, wherein the logic, as referred to herein, can include any suitable hardware (e.g., a processor, among others), software (e.g., an application, among others), firmware, or any suitable combination of hardware, software, and firmware.

Example 1

In some examples, a system for driving current includes a circuit to receive an input voltage. The circuit is to produce a current to be provided to one or more light-emitting diodes. The produced current is to be linearly dependent on the input voltage.

Example 2

In some examples, the system of EXAMPLE 1, where the system includes the one or more light-emitting diodes. The one or more light-emitting diodes includes a plurality of light-emitting diodes arranged in parallel with each other. The current is to be provided to the plurality of light-emitting diodes.

Example 3

In some examples, the system of EXAMPLE 1, where the plurality of light-emitting diodes are redundant light-emitting diodes. If any one or more of the plurality of light-emitting diodes is not functional, the current is to be provided to light-emitting diodes of the plurality of light-emitting diodes that are functional.

Example 4

In some examples, the system of EXAMPLE 1, where one or more of the one or more light-emitting diodes is a micro light-emitting diode, or where one or more of the one or more light-emitting diodes is an organic light-emitting diode. Each of the light-emitting diodes can be a micro light-emitting diode. Each of the light-emitting diodes can be an organic light-emitting diode.

Example 5

In some examples, the system of EXAMPLE 1, wherein the circuit is a transconductance amplifier, and/or a linearizer, and/or a current mirror, and/or a transconductor, and/or a differential transconductance amplifier.

Example 6

In some examples, the system of EXAMPLE 1, where the circuit includes a plurality of transistors.

Example 7

In some examples, the system of EXAMPLE 6, where the current is dependent on a size of one or more of the transistors.

Example 8

In some examples, the system of EXAMPLE 7, where the current is dependent on a width to length ratio of one or more of the transistors.

Example 9

In some examples, the system of EXAMPLE 6, where one or more of the transistors are a first size and one or more of the transistors are a second size. The current is dependent on the first size and on the second size.

Example 10

In some examples, the system of EXAMPLE 9, where the transistors of the first size have a first width to length ratio, and the transistors of the second size have a second width to length ratio. The current is dependent on the first width to length ratio and on the second width to length ratio.

Example 11

In some examples, the system of EXAMPLE 1, where the circuit is a digital pixel driving circuit.

Example 12

In some examples, the system of EXAMPLE 1, where the circuit includes CMOS technology, and/or pMOS transistors, and/or nMOS transistors.

Example 13

In some examples, the system of EXAMPLE 1, where the circuit includes one or more low-temperature polycrystalline silicon channel thin film transistors.

Example 14

In some examples, the system of EXAMPLE 1, where the circuit includes one or more indium gallium zinc oxide channel thin film transistors.

Example 15

In some examples, a display driver system includes a plurality of pixel driver circuits. Each of the pixel driver circuit drive current for a respective pixel in the display driver system. At least one of the plurality of pixel driver circuits is to receive an input voltage. The at least one of the plurality of pixel driver circuits is also to produce a current to be provided to one or more light-emitting diodes of the respective pixel. The current is to be linearly dependent on the input voltage.

Example 16

In some examples, the system of EXAMPLE 15, where each of the plurality of pixel driver circuits is to receive an input voltage. Each of the plurality of pixel driver circuits is also to produce a current to be provided to one or more light-emitting diodes. The current produced by each of the pixel driver circuits is to be linearly dependent on the input voltage.

Example 17

In some examples, the system of EXAMPLE 15, where the plurality of pixel driver circuits includes a plurality of red pixel driver circuits, and/or a plurality of green pixel driver circuits, and/or a plurality of blue pixel driver circuits.

Example 18

In some examples, the system of EXAMPLE 15, where the at least one of the plurality of pixel driver circuits includes the one or more light-emitting diodes of the respective pixel. The one or more light-emitting diodes of the respective pixel includes a plurality of light-emitting diodes arranged in parallel with each other. The current is to be provided to the plurality of light-emitting diodes arranged in parallel with each other.

Example 19

In some examples, the system of EXAMPLE 15, where each of the light-emitting diodes is one of a micro light-emitting diode or an organic light-emitting diode.

Example 20

In some examples, the system of EXAMPLE 15, where the at least one of the plurality of pixel driver circuits includes a plurality of transistors. The current is dependent on a size of one or more of the transistors.

Example 21

In some examples, the system of EXAMPLE 20, where the current is dependent on a width to length ratio of one or more of the transistors.

Example 22

In some examples, the system of EXAMPLE 15, where the at least one of the plurality of pixel driver circuits includes a plurality of transistors. One or more of the transistors are a first size and one or more of the transistors are a second size. The current is dependent on the first size and on the second size.

Example 23

In some examples, the system of EXAMPLE 22, where the transistors of the first size have a first width to length ratio, and the transistors of the second size have a second width to length ratio. The current is dependent on the first width to length ratio and is also dependent on the second width to length ratio.

Example 24

In some examples, the system of EXAMPLE 15, where the at least one of the plurality of pixel driver circuits includes one or more low-temperature polycrystalline silicon channel thin film transistors.

Example 25

In some examples, the system of EXAMPLE 15, where the at least one of the plurality of pixel driver circuits includes one or more indium gallium zinc oxide channel thin film transistors.

Example 26

In some examples, a system for driving current includes a circuit to receive an input voltage, and to produce a current to be provided to one or more light-emitting diodes. The current is to be linearly dependent on the input voltage.

Example 27

In some examples, the system of EXAMPLE 26, where the system includes the one or more light-emitting diodes. The one or more light-emitting diodes include a plurality of light-emitting diodes arranged in parallel with each other. The current is to be provided to the plurality of light-emitting diodes arranged in parallel with each other.

Example 28

In some examples, the system of EXAMPLE 26, where the plurality of light-emitting diodes are redundant light-emitting diodes. If any one or more of the plurality of light-emitting diodes is not functional, the current is to be provided to light-emitting diodes of the plurality of light-emitting diodes that are functional.

Example 29

In some examples, the system of any of EXAMPLES 26-28, where each of the one or more light-emitting diodes is a micro light-emitting diode, or each of the one or more light-emitting diodes is an organic light-emitting diode, or each of the light-emitting diodes is either a micro light-emitting diode or an organic light-emitting diode.

Example 30

In some examples, the system of any of EXAMPLES 26-29, where the circuit includes at least one of a transconductance amplifier, and/or a linearizer, and/or a current mirror, and/or a transconductor, and/or a differential transconductance amplifier.

Example 31

In some examples, the system of any of EXAMPLES 26-30, where the circuit includes a plurality of transistors.

Example 32

In some examples, the system of EXAMPLE 31, where the current is dependent on a size of one or more of the transistors.

Example 33

In some examples, the system of EXAMPLE 32, where the current is dependent on a width to length ratio of one or more of the transistors.

Example 34

In some examples, the system of EXAMPLE 31, where one or more of the transistors are a first size and one or more of the transistors are a second size. The current is dependent on the first size and on the second size.

Example 35

In some examples, the system of EXAMPLE 34, where the transistors of the first size have a first width to length ratio, and the transistors of the second size have a second width to length ratio. The current is dependent on the first width to length ratio and on the second width to length ratio.

Example 36

In some examples, the system of any of EXAMPLES 26-36, where the circuit is a digital pixel driving circuit.

Example 37

In some examples, the system of any of EXAMPLES 26-36, where the circuit includes CMOS technology, and/or pMOS transistors, and/or nMOS transistors.

Example 38

In some examples, the system of any of EXAMPLES 26-36, where the circuit includes one or more low-temperature polycrystalline silicon channel thin film transistors, and/or the circuit includes one or more indium gallium zinc oxide channel thin film transistors.

Example 39

In some examples, a display driver system includes a plurality of pixel driver circuits. Each of the pixel drive circuits drive current for a respective pixel in the display driver system. At least one of the plurality of pixel driver circuits is to receive an input voltage, and to produce a current to be provided to one or more light-emitting diodes of the respective pixel. The current is to be linearly dependent on the input voltage.

Example 40

In some examples, the system of EXAMPLE 39, where each of the plurality of pixel driver circuits is to receive an input voltage, and to produce a current to be provided to one or more light-emitting diodes. Each of the produced currents is to be linearly dependent on the input voltage.

Example 41

In some examples, a system for driving current includes means for receiving an input voltage. The system for driving current also includes means for producing a current to be provided to one or more light-emitting diodes. The current is to be linearly dependent on the input voltage.

Example 42

In some examples, the system of EXAMPLE 41, where the one or more light-emitting diodes includes a plurality of light-emitting diodes arranged in parallel with each other. If any one or more of the plurality of light-emitting diodes is not functional, the current is to be provided to light-emitting diodes of the plurality of light-emitting diodes that are functional.

Example 43

In some examples, the system of EXAMPLE 41 or 42, where each of the one or more light-emitting diodes is one of a micro light-emitting diode or an organic light-emitting diode. Each of the light-emitting diodes can be a micro light-emitting diode. Each of the light-emitting diodes can be an organic light-emitting diode.

Example 44

In some examples, the system of any of EXAMPLES 41-43, where the circuit includes a plurality of transistors. The current is dependent on a size of one or more of the transistors.

Example 45

In some examples, the system of any of EXAMPLES 41-44, where the circuit includes a plurality of transistors. The current is dependent on a width to length ratio of one or more of the transistors.

Example 46

In some examples, a method for driving current includes receiving an input voltage, producing a current that is linearly dependent on the input voltage, and providing the current to one or more light-emitting diodes.

Example 47

In some examples, the method of EXAMPLE 46, where if any one or more of the plurality of light-emitting diodes is not functional, providing the current to light-emitting diodes of the plurality of light-emitting diodes that are functional.

Example 48

In some examples, the method of EXAMPLE 46 or 47, where one or more of the receiving, the producing and the providing are implemented using a circuit that includes a plurality of transistors. The current is dependent on a size of one or more of the transistors.

Example 49

In some examples, the method of any of EXAMPLES 46-48, where one or more of the receiving, the producing and the providing are implemented using a circuit including a plurality of transistors. The current is dependent on a width to length ratio of one or more of the transistors.

Example 50

In some examples, the method of any of EXAMPLES 46-49, where one or more of the receiving, the producing and the providing are implemented using a circuit including a plurality of transistors. One or more of the transistors are a first size and one or more of the transistors are a second size. The current is dependent on the first size and on the second size.

Example 51

In some examples, a method for driving current includes receiving an input voltage, producing a current that is linearly dependent on the input voltage, and providing the current to one or more light-emitting diodes.

Example 52

In some examples, the method of EXAMPLE 51, including providing the current to a plurality of light-emitting diodes arranged in parallel with each other, and/or providing the current to a plurality of redundant light-emitting diodes, and/or providing the current to a plurality of redundant light-emitting diodes, and if any one or more of the redundant light-emitting diodes is not functional, providing the current to one or more of the light-emitting diodes that are functional, and/or if any one or more of the light-emitting diodes is not functional, providing the current to one or more of the light-emitting diodes that are functional.

Example 53

In some examples, the method of EXAMPLE 51 or 52, where one or more (or each) of the one or more light-emitting diodes is a micro light-emitting diode, and/or where one or more (or each) of the one or more light-emitting diodes is an organic light-emitting diode.

Example 54

In some examples, the method of any of EXAMPLES 51-53, where one or more of the receiving, the producing and the providing are implemented using a circuit. The circuit includes at least one of a transconductance amplifier, and/or a linearizer, and/or a current mirror, and/or a transconductor, and/or a differential transconductance amplifier.

Example 55

In some examples, the method of any of EXAMPLES 51-54, where one or more of the receiving, the producing and the providing are implemented using a circuit. The circuit includes a plurality of transistors.

Example 56

In some examples, the method of any of EXAMPLES 51-55, where one or more of the receiving, the producing and the providing are implemented using a circuit. The circuit includes a plurality of transistors. The current is dependent on a size of one or more of the transistors.

Example 57

In some examples, the method of any of EXAMPLES 51-56, where one or more of the receiving, the producing and the providing are implemented using a circuit. The circuit includes a plurality of transistors. The current is dependent on a width to length ratio of one or more of the transistors.

Example 58

In some examples, the method of any of EXAMPLES 51-57, where one or more of the receiving, the producing and the providing are implemented using a circuit. The circuit includes a plurality of transistors. One or more of the transistors are a first size and one or more of the transistors are a second size. The current is dependent on the first size and on the second size.

Example 59

In some examples, the method of EXAMPLE 58, where the transistors of the first size have a first width to length ratio, and the transistors of the second size have a second width to length ratio. The current is dependent on the first width to length ratio and on the second width to length ratio.

Example 60

In some examples, the method of any of EXAMPLES 51-59, where one or more of the receiving, the producing and the providing are implemented using a digital pixel driving circuit.

Example 61

In some examples, the method of any of EXAMPLES 51-60, where one or more of the receiving, the producing and the providing are implemented using CMOS technology, and/or pMOS transistors, and/or nMOS transistors.

Example 62

In some examples, the method of any of EXAMPLES 51-61, where one or more of the receiving, the producing and the providing are implemented using a circuit that includes one or more low-temperature polycrystalline silicon channel thin film transistors, and/or that includes one or more indium gallium zinc oxide channel thin film transistors.

Example 63

In some examples, an apparatus including means to perform a method as in any of EXAMPLES 50-62.

Example 64

In some examples, an apparatus including means for driving current for a plurality of pixels in a display. The means for driving includes for one or more of the pixels in the display a respective means to perform as in EXAMPLE 63.

Example 65

In some examples, an apparatus including means for driving current for a plurality of pixels in a display. The means for driving includes for all of the pixels in the display a respective means to perform as in EXAMPLE 63.

Although example embodiments of the disclosed subject matter are described with reference to circuit and block diagrams herein, persons of ordinary skill in the art will readily appreciate that many other ways of implementing the disclosed subject matter may alternatively be used. For example, the order of execution of the blocks in flow diagrams may be changed, and/or some of the blocks in block/flow diagrams described may be changed, eliminated, or combined. Additionally, some of the circuit elements may be changed, eliminated, or combined.

In the preceding description, various aspects of the disclosed subject matter have been described. For purposes of explanation, specific numbers, systems and configurations were set forth in order to provide a thorough understanding of the subject matter. However, it is apparent to one skilled in the art having the benefit of this disclosure that the subject matter may be practiced without the specific details. In other instances, well-known features, components, or modules were omitted, simplified, combined, or split in order not to obscure the disclosed subject matter.

Various embodiments of the disclosed subject matter may be implemented in hardware, firmware, software, or combination thereof, and may be described by reference to or in conjunction with program code, such as instructions, functions, procedures, data structures, logic, application programs, design representations or formats for simulation, emulation, and fabrication of a design, which when accessed by a machine results in the machine performing tasks, defining abstract data types or low-level hardware contexts, or producing a result.

Program code may represent hardware using a hardware description language or another functional description language which essentially provides a model of how designed hardware is expected to perform. Program code may be assembly or machine language or hardware-definition languages, or data that may be compiled and/or interpreted. Furthermore, it is common in the art to speak of software, in one form or another as taking an action or causing a result. Such expressions are merely a shorthand way of stating execution of program code by a processing system which causes a processor to perform an action or produce a result.

Program code may be stored in, for example, volatile and/or non-volatile memory, such as storage devices and/or an associated machine readable or machine accessible medium including solid-state memory, hard-drives, floppy-disks, optical storage, tapes, flash memory, memory sticks, digital video disks, digital versatile discs (DVDs), etc., as well as more exotic mediums such as machine-accessible biological state preserving storage. A machine readable medium may include any tangible mechanism for storing, transmitting, or receiving information in a form readable by a machine, such as antennas, optical fibers, communication interfaces, etc. Program code may be transmitted in the form of packets, serial data, parallel data, etc., and may be used in a compressed or encrypted format.

Program code may be implemented in programs executing on programmable machines such as mobile or stationary computers, personal digital assistants, set top boxes, cellular telephones and pagers, and other electronic devices, each including a processor, volatile and/or non-volatile memory readable by the processor, at least one input device and/or one or more output devices. Program code may be applied to the data entered using the input device to perform the described embodiments and to generate output information. The output information may be applied to one or more output devices. One of ordinary skill in the art may appreciate that embodiments of the disclosed subject matter can be practiced with various computer system configurations, including multiprocessor or multiple-core processor systems, minicomputers, mainframe computers, as well as pervasive or miniature computers or processors that may be embedded into virtually any device. Embodiments of the disclosed subject matter can also be practiced in distributed computing environments where tasks may be performed by remote processing devices that are linked through a communications network.

Although operations may be described as a sequential process, some of the operations may in fact be performed in parallel, concurrently, and/or in a distributed environment, and with program code stored locally and/or remotely for access by single or multi-processor machines. In addition, in some embodiments the order of operations may be rearranged without departing from the spirit of the disclosed subject matter. Program code may be used by or in conjunction with embedded controllers.

While the disclosed subject matter has been described with reference to illustrative embodiments, this description is not intended to be construed in a limiting sense. Various modifications of the illustrative embodiments, as well as other embodiments of the subject matter, which are apparent to persons skilled in the art to which the disclosed subject matter pertains are deemed to lie within the scope of the disclosed subject matter. For example, in each illustrated embodiment and each described embodiment, it is to be understood that the diagrams of the figures and the description herein is not intended to indicate that the illustrated or described devices include all of the components shown in a particular figure or described in reference to a particular figure. In addition, each element may be implemented with logic, wherein the logic, as referred to herein, can include any suitable hardware (e.g., a processor, among others), software (e.g., an application, among others), firmware, or any suitable combination of hardware, software, and firmware, for example.

What is claimed is:

1. A system for driving current for a pixel in a display driving system, comprising:

a plurality of light-emitting diodes coupled in parallel with each other, the plurality of micro light-emitting diodes to emit light for the pixel in the display driving system;

a transconductance amplifier including a first transistor to receive an input voltage and a second transistor coupled to the first transistor;

a linearizer including a third transistor and a fourth transistor coupled in parallel, the third transistor and the fourth transistor each coupled to the first transistor, the linearizer to drive current in response to the input voltage to produce a current to be provided to the plurality of light-emitting diodes, wherein the current to be provided to the plurality of light-emitting diodes is linearly dependent on the input voltage.

2. The system of claim 1, wherein the plurality of light-emitting diodes comprise redundant light-emitting diodes, wherein if any one or more of the plurality of light-emitting diodes is not functional, the current is to be provided to light-emitting diodes of the plurality of light-emitting diodes that are functional.

3. The system of claim 1, wherein the transconductance amplifier is a differential transconductance amplifier.

4. The system of claim 1, wherein the current is dependent on a size of one or more of the first transistor, the second transistor, the third transistor, and the fourth transistor.

5. The system of claim 4, wherein the current is dependent on a width to length ratio of one or more of the first transistor, the second transistor, the third transistor, and the fourth transistor.

6. The system of claim 1, wherein one or more of the first transistor, the second transistor, the third transistor, and the fourth transistor are a first size and one or more of the first transistor, the second transistor, the third transistor, and the fourth transistor are a second size, wherein the current is dependent on the first size and on the second size.

7. The system of claim 6, wherein the transistors of the first size have a first width to length ratio, and the transistors of the second size have a second width to length ratio, wherein the current is dependent on the first width to length ratio and on the second width to length ratio.

8. The system of claim 1, wherein the system includes at least one of CMOS technology, pMOS transistors, and nMOS transistors.

9. The system of claim 1, wherein the system includes one or more low-temperature polycrystalline silicon channel thin film transistors.

10. The system of claim 1, wherein the system includes one or more indium gallium zinc oxide channel thin film transistors.

11. The system of claim 1, wherein an applied data voltage is below 0.5 volts.

12. The system of claim 1, wherein the driving includes controlling gray levels using pulse width modulation or using pulse density modulation.

13. The system of claim 1, comprising the circuit to control the current using either pulse width modulation or pulse density modulation.

14. A display driver system, comprising:

a plurality of pixel driver circuits to each drive current for a respective pixel in the display driver system, at least one of the plurality of pixel driver circuits including:

a transconductance amplifier including a first transistor to receive an input voltage and a second transistor coupled to the first transistor;

a linearizer including a third transistor and a fourth transistor coupled in parallel, the third transistor and the fourth transistor each coupled to the first transistor, the linearizer to drive current in response to the input voltage to produce a current to be provided to a plurality of light-emitting diodes of the respective pixel, wherein the plurality of light-emitting diodes of each respective pixel are coupled in parallel with each other, the plurality of light-emitting diodes of each respective pixel to emit light for the respective pixel, wherein the current to be provided to the one or more light-emitting diodes of the respective pixel is linearly dependent on the input voltage.

15. The system of claim 14, each of the plurality of pixel driver circuits to receive a respective input voltage, and to drive current in response to the respective input voltage to produce a current to be provided to a plurality of respective light-emitting diodes for the respective pixel, wherein the current is to be linearly dependent on the respective input voltage.

16. The system of claim 14, wherein the plurality of pixel driver circuits includes a plurality of red pixel driver circuits, a plurality of green pixel driver circuits, and a plurality of blue pixel driver circuits.

17. The system of claim 14, wherein the current is dependent on a size of one or more of the first transistor, the second transistor, the third transistor, and the fourth transistor.

18. The system of claim 17, wherein the current is dependent on a width to length ratio of one or more of the first transistor, the second transistor, the third transistor, and the fourth transistor.

19. The system of claim 14, wherein one or more of the first transistor, the second transistor, the third transistor, and the fourth transistor are a first size and one or more of the first transistor, the second transistor, the third transistor, and the fourth transistor are a second size, and wherein the current is dependent on the first size and on the second size.

20. The system of claim 19, wherein the transistors of the first size have a first width to length ratio, and the transistors of the second size have a second width to length ratio, and wherein the current is dependent on the first width to length ratio and on the second width to length ratio.

21. The system of claim 14, wherein the at least one of the plurality of pixel driver circuits includes one or more low-temperature polycrystalline silicon channel thin film transistors.

22. The system of claim 14, wherein the at least one of the plurality of pixel driver circuits includes one or more indium gallium zinc oxide channel thin film transistors.

23. The system of claim 14, wherein an applied data voltage is below 0.5 volts.

24. The system of claim 14, wherein the driving includes controlling gray levels using pulse width modulation or using pulse density modulation.

25. The system of claim 14, comprising the circuit to control the current using either pulse width modulation or pulse density modulation.

* * * * *